US005791414A

United States Patent [19]

Skinner et al.

[11] Patent Number: 5,791,414

[45] Date of Patent: Aug. 11, 1998

[54] EARLY EVALUATION FORMATION TESTING SYSTEM

[75] Inventors: Neal G. Skinner, Lewisville; Paul D. Ringgenberg, Carrollton, both of Tex.

[73] Assignee: Halliburton Energy Services, Inc., Dallas, Tex.

[21] Appl. No.: 699,613

[22] Filed: Aug. 19, 1996

[51] Int. Cl.[6] ..... F21B 33/127

[52] U.S. Cl. ..... 166/187; 166/191; 166/319

[58] Field of Search ..... 166/264, 187, 166/191, 319, 320

[56] References Cited

U.S. PATENT DOCUMENTS

| | | | |
|---|---|---|---|
| 4,361,195 | 11/1982 | Evans | 166/178 X |
| 4,877,086 | 10/1989 | Zunkel | 166/187 X |
| 5,101,904 | 4/1992 | Gilbert | 166/319 |
| 5,383,520 | 1/1995 | Tucker et al. | 166/319 X |
| 5,404,946 | 4/1995 | Hess | 166/187 |
| 5,649,597 | 7/1997 | Ringgenberg | 166/320 X |

*Primary Examiner*—William P. Neuder

*Attorney, Agent, or Firm*—William M. Imwalle; Paul I. Herman; J. Richard Konneker

[57] ABSTRACT

A formation testing system provides the ability to reliably and repeatedly perform tests, such as drawdown tests, on closely spaced apart formations intersected by subterranean wellbores without relying on absolute fluid pressure for actuation thereof. In a preferred embodiment, a formation testing system is alternately configured for normal drilling operations or for fluid sampling operations by applying preselected differential pressures to the system. In a representatively illustrated preferred embodiment, a formation testing system has opposing pistons which cooperate with uniquely configured ratchet mechanisms to change the system's configuration in response to changes in differential pressure applied thereto.

38 Claims, 29 Drawing Sheets

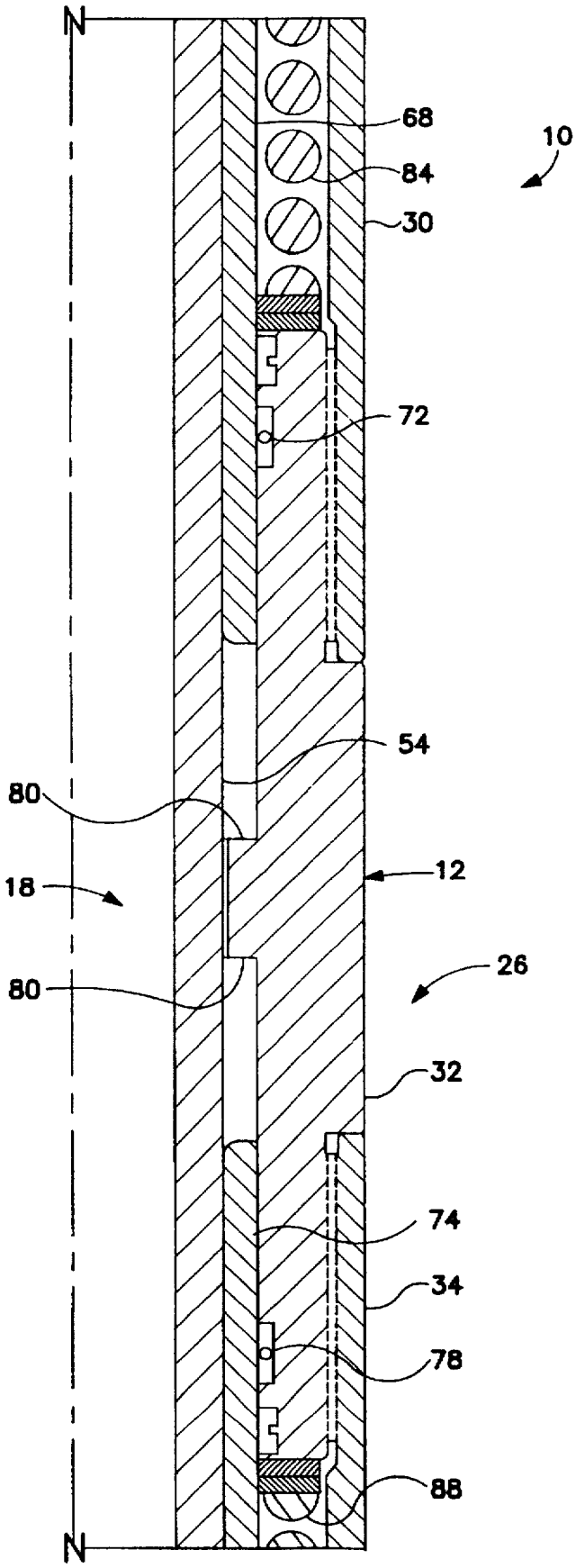
FIG. IC

EARLY EVALUATION FORMATION TESTING SYSTEM

BACKGROUND OF THE INVENTION

The present invention relates generally to formation testing in subterranean wellbores and, in a preferred embodiment thereof, more particularly provides a formation testing system which permits early evaluation of formations intersected by uncased wellbores.

It is well known in the subterranean well drilling and completion arts to perform tests on formations intersected by a wellbore. Such tests are typically performed in order to determine geological and other physical properties of the formations and fluids contained therein. For example, by making appropriate measurements, a formation's permeability and porosity, and the fluid's resistivity, temperature, pressure, and bubble point may be determined. These and other characteristics of the formation and fluid contained therein may be determined by performing tests on the formation before the well is completed.

It is of considerable economic importance for tests such as those described hereinabove to be performed as soon as possible after the formation has been intersected by the wellbore. Early evaluation of the potential for profitable recovery of the fluid contained therein is very desirable. For example, such early evaluation enables completion operations to be planned more efficiently.

Where the early evaluation is actually accomplished during drilling operations within the well, the drilling operations may also be more efficiently performed, since results of the early evaluation may then be used to adjust parameters of the drilling operations. In this respect, it is known in the art to interconnect formation testing equipment with a drill string so that, as the wellbore is being drilled, and without removing the drill string from the wellbore, formations intersected by the wellbore may be periodically tested.

In typical formation testing equipment suitable for interconnection with a drill string during drilling operations, various devices and mechanisms are provided for isolating a formation from the remainder of the wellbore, drawing fluid from the formation, and measuring physical properties of the fluid and the formation. Unfortunately, due to the constraints imposed by the necessity of interconnecting the equipment with the drill string, typical formation testing equipment is not suitable for use in these circumstances.

As an example of the shortcomings of typical formation testing equipment, absolute downhole fluid pressure is generally utilized to actuate the equipment. In order to configure the equipment for use in a particular wellbore, it is usually necessary to provide precharged gas chambers or other pressure reference devices, so that when a desired fluid pressure is reached at the equipment in the wellbore, the equipment will be appropriately actuated. Of course, absolute fluid pressure varies with depth within a wellbore and conditions often arise making it extremely difficult to accurately determine a desired gas chamber precharge pressure (for example, gas pressure varies with temperature and it may not be known beforehand what the temperature at a certain location within the wellbore will be at the time it is desired to test a formation). These and other limitations of typical formation testing equipment arise due to reliance on absolute fluid pressure for actuation thereof.

As another example of the shortcomings of typical formation testing equipment utilizing absolute fluid pressure for actuation thereof, such equipment usually requires that specific steps, such as opening and closing of valves and changes of configurations therein, happen upon attainment of specific absolute fluid pressures. Accordingly, an operator at the earth's surface must apply such absolute fluid pressures at the earth's surface using pumps, etc. and simultaneously observe the fluid pressure in the wellbore and/or drill string to determine whether or not such absolute fluid pressures have been attained, exceeded, etc. It would be much more desirable to have such valve openings and closings and changes of configurations occur upon a release of pressure (when pressure regulation is more controllable and pressure spikes and noise from pumps are not present) or upon reaching a desired differential pressure at the equipment.

As yet another example of the shortcomings of typical formation testing equipment, complicated and failure-prone mechanisms and devices are usually utilized to inflate packer elements and draw fluid from a formation into the equipment for testing and recording of properties of the fluid. Such formation isolating and fluid drawing mechanisms and devices require, for example, provision of electrical power, rotation of the drill string, circulation of fluid through the drill string during the fluid drawing operation, etc. These mechanisms and devices are inefficient and are disruptive to normal drilling operations.

Additionally, typical formation testing equipment does not permit performance of tests at closely spaced apart intervals (usually due to widely spaced apart inflatable packer elements on the typical formation testing equipment), does not provide a continuous record of fluid properties, does not permit simultaneous valve opening and closing with packer inflating and deflating, and does not protect packer elements thereon from damage due to contact with sides of the wellbore.

From the foregoing, it can be seen that it would be quite desirable to provide an early evaluation formation testing system which is not cumbersome to operate or failure-prone, does not rely on absolute fluid pressure for actuation or changes of configuration thereof, does not require rotation of the drill string, electrical power, or circulation of fluid therethrough for drawing of fluid thereinto, does not rely on attainment of specific absolute fluid pressures for opening and closing of valves and changes of configuration, does not require complicated and failure-prone mechanisms and devices for inflation and deflation of packers thereon, but which is suitable for use in virtually any wellbore or wellbore portion, which utilizes differential fluid pressure for actuation thereof, which permits performance of tests at closely spaced apart intervals, which provides a continuous record of fluid properties, which permits simultaneous valve opening and closing with packer inflating and deflating, and which protects packer elements thereon from damage due to contact with sides of the wellbore. It is accordingly an object of the present invention to provide such an early evaluation formation testing system.

SUMMARY OF THE INVENTION

In carrying out the principles of the present invention, in accordance with an embodiment thereof, an early evaluation formation testing system is provided which is a combination of packers, valves, pistons, ratchet mechanisms, a pump, and other elements uniquely configured so that the system may be transported into a subterranean well as part of a drill string during drilling operations. Periodically, the formation testing system may be activated to perform one or more tests on formations intersected by the well by applying a predetermined sequence of fluid pressures to the drill string.

Additionally, the formation testing system is designed to permit such tests to be performed at closely spaced apart intervals.

In broad terms, apparatus is provided which is operatively positionable in a subterranean well. In a representatively illustrated embodiment of the present invention, the apparatus includes a flow passage, first and second pistons, and a valve. The flow passage is formed interiorly through the apparatus.

The first piston is configured to displace in response to fluid pressure in the flow passage. The second piston is also configured to displace in response to fluid pressure in the flow passage, the second piston displacement being oppositely directed relative to the first piston displacement. The valve is configured to selectively permit and prevent fluid flow through the flow passage in response to displacement of a selected one of the first and second pistons.

Also provided is an apparatus which includes first and second generally tubular members, and first and second packers. The first packer has opposite ends and a radially outwardly extendable first seal member disposed between the opposite ends. The first packer is exteriorly disposed on the first tubular member with one of the first packer opposite ends being attached to the first tubular member. The other of the first packer opposite ends is axially slidingly disposed on the first tubular member.

The second tubular member has opposite ends and an opening formed through a sidewall portion thereof between the opposite ends. The second tubular member is exteriorly slidingly disposed on the first tubular member. One of the second tubular member opposite ends is attached to the other of the first packer opposite ends.

The second packer has opposite ends and a radially outwardly extendable second seal member disposed between the opposite ends. The second packer is exteriorly slidingly disposed on the first tubular member. One of the second packer opposite ends is attached to the other of the second tubular member opposite ends, and the other of the second packer opposite ends is axially slidingly disposed on the first tubular member. When the first and second seal members are radially outwardly extended, the second packer, second tubular member, and the other of the first packer opposite ends are capable of slidingly displacing on the first tubular member.

Another apparatus operatively disposable within a subterratean well is provided, for use where the well has a wellbore intersecting a formation. The apparatus includes a crossover, and first and second inflatable packers.

The crossover is generally tubular and has interior and exterior surfaces, first and second opposite ends, a first opening providing fluid communication from the interior to the exterior surface, and a second opening providing fluid communication from the first to the second opposite end.

The first inflatable packer is attached to the crossover first opposite end so that the first inflatable packer is in fluid communication with the second opening. The first inflatable packer is capable of being inflated in response to fluid pressure in the second opening to sealingly engage the wellbore.

The second inflatable packer is attached to the crossover second opposite end so that the second inflatable packer is in fluid communication with the second opening. The second inflatable packer is also capable of being inflated in response to fluid pressure in the second opening to sealingly engage the wellbore. The first and second inflatable packers are capable of sealingly engaging the wellbore adjacent the formation, and the first opening is thereby placed in fluid communication with the formation and in fluid isolation from the remainder of the wellbore.

Yet another apparatus operatively positionable in a subterranean well is provided by the present invention. The apparatus includes first and second tubular members, first and second circumferential seals, and a flow passage.

The first tubular member has first and second interior portions, the second interior portion being radially reduced relative to the first interior portion. The second tubular member has first and second exterior portions, the second exterior portion being radially reduced relative to the first exterior portion. The second tubular member is telescopingly received in the first tubular member, such that a variable annular volume is formed radially between the second exterior portion and the first interior portion.

The first seal sealingly engages the first interior surface and the first exterior surface. The second seal sealingly engages the second interior surface and the second exterior surface.

The flow passage is in fluid communication with the annular volume. The flow passage is capable of fluid communication with an annulus formed radially between the apparatus and sides of the subterranean well. When the first and second tubular members are displaced relative to each other to increase the annular volume, the flow passage permits fluid flow from the annulus to the annular volume.

Still another apparatus operatively positionable within a subterranean wellbore is provided herein for use where the wellbore intersects a plurality of formations. The apparatus includes first and second inflatable packers, a sample flow passage, a pump, and a valve.

The first and second inflatable packers are capable of sealingly engaging sides of the wellbore adjacent a selected one of the formations. The sample flow passage is disposed axially between the first and second inflatable packers, and is capable of fluid communication with the selected one of the formations when the first and second inflatable packers sealingly engage sides of the wellbore adjacent the selected one of the formations.

The pump is capable of drawing fluid from the selected one of the formations through the sample flow passage. The valve is in selectable fluid communication with the first and second inflatable packers. The valve permits sealing engagement of the first and second inflatable packers with the sides of the wellbore adjacent the selected one of the formations, permits disengagement of the first and second inflatable packers from the sides of the wellbore adjacent the selected one of the formations, and permits sealing engagement of the first and second inflatable packers with the sides of the wellbore adjacent another one of the formations subsequent to disengagement of the first and second inflatable packers from the sides of the wellbore adjacent the selected one of the formations.

Yet another apparatus operatively positionable in a subterranean well is provided by the present invention. The apparatus includes an actuator member, first and second pistons, first and second ratchets, and first and second pins.

The first piston is reciprocably disposed relative to the actuator member. The first piston is capable of displacing relative to the actuator member in response to a first decrease of fluid pressure acting thereon.

The first ratchet is attached to the first piston or the actuator member and has a first path formed thereon. The first pin is attached to the first piston or the actuator member and is operatively disposed in the first path. The first path is configured to permit the first piston to displace the actuator member in a first axial direction in response to the first decrease of fluid pressure.

The second piston is reciprocably disposed relative to the actuator member. The second ratchet is attached to the actuator member or the second piston and has a second path formed thereon. The second pin is attached to the actuator member or the second piston and is operatively disposed in the second path. The second path is configured to permit the second piston to displace the actuator member in a second axial direction opposite to the first axial direction in response to the second decrease of fluid pressure.

Still another apparatus operatively positionable in a subterranean wellbore is provided. The apparatus includes an outer housing, an inner mandrel, and first and second pistons.

The outer housing is generally tubular and has an exterior side surface. The inner mandrel is also generally tubular and has an interior side surface. The inner mandrel is received in the outer housing.

Each of the first and second pistons is generally tubular and is axially slidably disposed radially between the outer housing and the inner mandrel. The first piston is capable of displacing in a first axial direction relative to the inner mandrel in response to a differential fluid pressure from the interior side surface of the inner mandrel to the exterior side surface of the outer housing. The second piston is capable of displacing in a second axial direction relative to the inner mandrel opposite to the first axial direction in response to the differential fluid pressure.

Yet another apparatus operatively positionable in a subterranean well is provided by the present invention. The apparatus includes a ratchet, a pin, a force member, and a resistance member.

The ratchet has a path formed thereon. The path has first and second interconnected portions. The pin is operatively disposed in the path, the pin being displaceable in the path relative to the ratchet.

The first force member is capable of displacing the pin in the path in a first direction relative to the ratchet. The resistance member is attached to the first force member and is capable of selectively inhibiting displacement of the pin in the path in the first direction relative to the ratchet to thereby permit the pin to displace from the first portion to the second portion.

Additionally, the present invention provides apparatus operatively positionable in a subterranean well, which apparatus includes first and second inflatable packers and first and second centralizers.

The first and second inflatable packers are attached to each other. Each of the first and second inflatable packers is radially outwardly extendable from a deflated configuration to an inflated configuration.

The first and second centralizers axially straddle the first and second inflatable packers. Each of the first and second centralizers has an outer side surface which is radially outwardly disposed relative to the first and second inflatable packers in the deflated configuration, and each of the first and second centralizer outer side surfaces is radially inwardly disposed relative to the first and second inflatable packers in the inflated configuration.

BRIEF DESCRIPTION OF THE DRAWINGS

FIGS. 1A–1G are quarter-sectional views of successive axial portions of a valve actuating section of a formation testing system embodying principles of the present invention, the valve actuating section being shown in a configuration in which a valve therein is open;

DETAILED DESCRIPTION

Figure 1A:
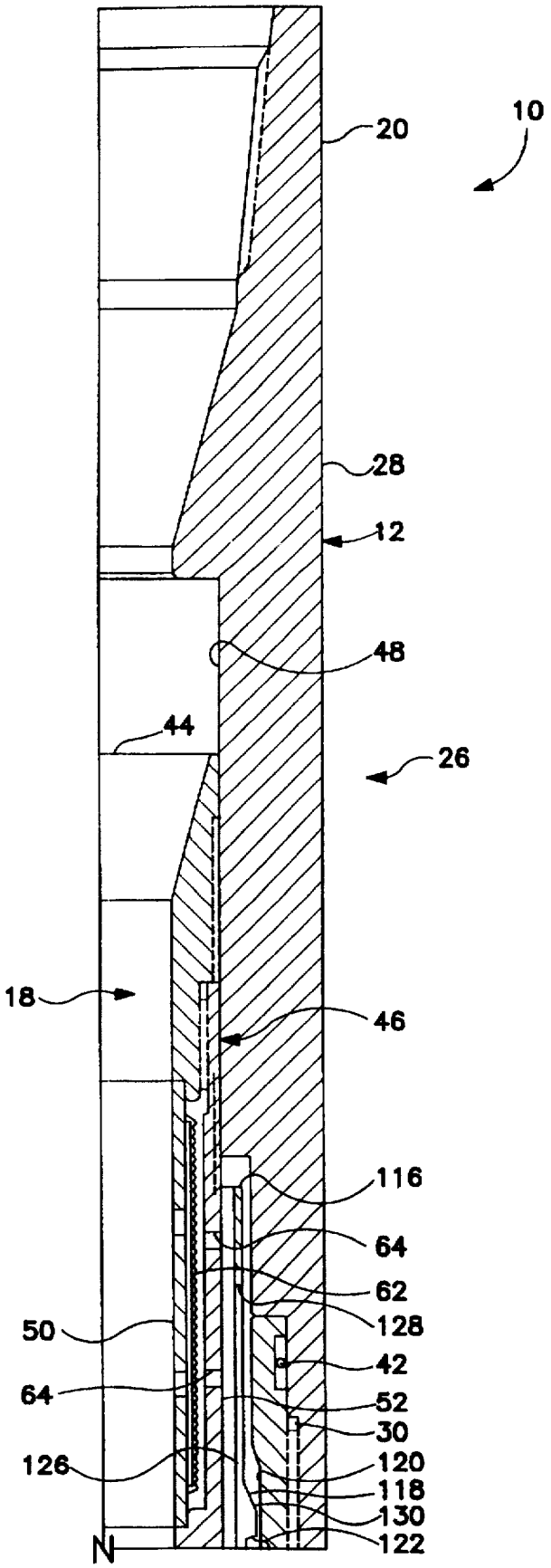

In the following detailed descriptions of the embodiments of the present invention representatively illustrated in the accompanying figures, directional terms, such as "upper", "lower", "upward", "downward", etc., are used in relation to the illustrated embodiments as they are depicted in the accompanying figures, the upward direction being toward the top of the corresponding figure, and the downward direction being toward the bottom of the corresponding figure. It is to be understood that the embodiments may be utilized in vertical, horizontal, inverted, or inclined orientations without deviating from the principles of the present invention. It is also to be understood that the embodiments are schematically represented in the accompanying figures.

Representatively illustrated in FIGS. 1A–1G, 2, 3, and 4A–4G is a valve actuating section 12 of a formation testing system 10 which embodies principles of the present invention. The valve actuating section 12 is shown in FIGS. 1A–1G in a configuration in which it would normally be run into a wellbore and disposed therein, fluids being permitted to flow axially through an open valve portion 16 (see FIG. 1E). In FIGS. 4A-4G, the valve actuating section 12 is shown in a configuration in which the valve portion 16 has been closed (see FIG. 4E), thereby preventing circulation of fluids through a main axial flow passage 18 which extends from an upper internally threaded end 20 to a lower externally threaded end 22 of the valve actuating section.

A fluid sampling section 14 of the formation testing system 10 is shown in FIGS. 5A–5F, 6, 7, 8, and 9A–9F and is separately described hereinbelow. It is important to understand, however, that the valve actuating section 12 and the fluid sampling section 14 cooperate one with the other in the formation testing system 10. Specifically, the externally threaded lower end 22 of the valve actuating section 12 may be coupled directly to an internally threaded upper end 24 of the fluid sampling section 14, or other threaded tubular members (not shown) may be interconnected therebetween.

Referring specifically now to FIGS. 1A–1G, it may be clearly seen that the flow passage 18 is open for fluid flow therethrough from the upper end 20 to the lower end 22, the valve portion 16 being open. It is well known to those skilled in the art that, during typical wellbore drilling operations, fluid (such as drilling mud) is circulated through a drill string (not shown) to ports formed through a drill bit (not shown) attached to a lower end of the drill string. It is to be understood that the valve actuating section 12 may be interconnected into such a drill string at its upper and lower ends 20, 22, without impeding such circulating flow of fluids therethrough during drilling operations.

With the valve actuating section 12 in its open configuration as shown in FIGS. 1A–1G, fluids may be circulated downward through the drill string, through the flow passage 18, an d through the ports in the drill bit. From the drill bit, such fluids are typically flowed back to the earth's surface through a n annulus formed radially between the drill string and the wellbore. In FIGS. 1A–1G, an annulus 26 is indicated as being disposed external to the valve actuating section 12, as would be the case if the valve actuating section were interconnected in the drill string.

The valve actuating section 12 is uniquely capable of performing its many functions (which are more fully described hereinbelow) in response to various differences in fluid pressure between the flow passage 18 and the annulus 26. Thus, the absolute fluid pressure at any point in the wellbore is not determinative of the configuration of the valve actuating section 12. It is the differential fluid pressure from the flow passage 18 to the annulus 26 (which is easily controllable by an operator at the earth's surface) that determines, among other things, whether the valve portion 16 is open or closed.

The valve actuating section 12 includes an axially extending and generally tubular upper connector 28 which has the upper end 20 formed thereon. The upper connector 28 may be threadedly and sealingly connected to a portion of a drill string for conveyance into a wellbore therewith. When so connected, the flow passage 18 is in fluid communication with the interior of the drill string.

An axially extending generally tubular upper housing 30 is threadedly and sealingly connected to the upper connector 28. The upper housing 30 is, in turn, threadedly connected to an axially extending generally tubular intermediate housing 32, which is threadedly connected to an axially extending generally tubular lower housing 34. The lower housing 34 is threadedly and sealingly connected to an axially extending generally tubular valve housing 36. The valve housing 36 is threadedly and sealingly connected to an axially extending generally tubular operator housing 38, which is threadedly and sealingly connected to an axially extending generally tubular lower connector 40. Each of the above-described sealing connections are sealed by means of a seal 42.

The upper connector 28 has an internally tapered generally tubular upper end portion 44 of an axially extending generally tubular inner mandrel assembly 46 axially slidingly received in an internal bore 48 formed in the upper connector. The inner mandrel assembly 46 includes the upper end portion 44, an upper ported sleeve 50, an upper sleeve 52, an intermediate sleeve 54, a lower sleeve 56, a lower ported sleeve 58, and an upper ball retainer 60. The upper end portion 44, upper sleeve 52, intermediate sleeve 54, lower sleeve 56, and upper ball retainer 60 are threadedly interconnected, and the upper and lower ported sleeves 50, 58 are axially retained between internal shoulders formed on the upper end portion, upper sleeve, lower sleeve, and upper ball retainer. Each of the upper and lower ported sleeves 50, 58 has a generally tubular screen 62 externally attached thereto for filtering debris from fluid passing therethrough.

Each of the upper and lower sleeves 52, 56 includes ports 64 formed therethrough radially opposite one of the screens 62. In this manner, fluid in the flow passage 18 is permitted to flow radially through the inner mandrel assembly 46 via the ports 64, the screens 62 preventing debris from also passing therethrough.

Each of the upper and lower housings 30, 34 includes ports 66 formed radially therethrough. The ports 66 permit fluid in the annulus 26 to enter the valve actuating section 12. As will be readily apparent to one of ordinary skill in the art upon careful consideration of the detailed description herein and the accompanying figures, ports 64 and 66 permit differential pressure between the fluid in the flow passage 18 and the fluid in the annulus 26 to act upon the valve actuating section 12 in a manner which causes the valve portion 16 to open or close as desired, among other operations.

In this regard, note that a generally tubular upper piston 68 is slidingly and sealingly received radially between the upper housing 30 and the intermediate sleeve 54, an external circumferential seal 70 carried on the upper piston internally sealingly engaging the upper housing, and an internal circumferential seal 72 carried on the intermediate housing 32 sealingly engaging the upper piston. Also note that a generally tubular lower piston 74 is slidingly and sealingly received radially between the lower housing 34 and the intermediate sleeve 54, an external circumferential seal 76 carried on the lower piston 74 sealingly engaging the lower housing, and an internal seal 78 carried on the intermediate housing 32 sealingly engaging the lower piston. Thus, a differential pressure area is formed between seals 70 and 72, and also between seals 76 and 78.

It will be readily appreciated that when fluid pressure in the flow passage 18, acting on the differential pressure areas of the upper and lower pistons 68 and 74 via ports 64, exceeds fluid pressure in the annulus 26, acting on the differential pressure areas of the upper and lower pistons via ports 66, the upper piston will be thereby biased in an axially downward direction and the lower piston will be thereby biased in an axially upward direction. Therefore, greater fluid pressure in the flow passage 18 than in the annulus 26 biases the upper and lower pistons 68, 74 axially toward each other and, conversely, greater fluid pressure in the annulus than in the flow passage biases the upper and lower pistons axially away from each other. Internal opposing shoulders 80 formed on the intermediate housing 32 limit the extent to which the pistons 68, 74 may travel axially toward each other, and internal shoulders 82 formed on the upper and lower housings 30, 34 limit the extent to which the pistons may travel axially away from each other.

A spirally wound compression spring 84 is installed axially between an external shoulder 86 formed on the upper piston 68 and the intermediate housing 32. In a similar manner, another spirally wound compression spring 88 is installed axially between an external shoulder 90 formed on the lower piston 74 and the intermediate housing 32. The springs 84, 88 are utilized in the valve actuating section 12 to bias the upper and lower pistons 68, 74 axially away from each other. Thus, with no difference in fluid pressure between the flow passage 18 and the annulus 26, the springs 84, 88 will act to maintain the upper and lower pistons 68, 74 in their greatest axially spaced apart configuration as shown in FIGS. 1A–1G.

It is to be understood that other biasing devices and mechanisms may be substituted for the springs 84, 88 without departing from the principles of the present invention. For example, gas springs or stacked bellville washers may be utilized to bias the upper and lower pistons away from each other.

A generally tubular upper pin retainer 92 is threadedly secured to an upper end 94 of the upper piston 68. In a similar manner, a generally tubular lower pin retainer 96 is threadedly secured to a lower end 98 of the lower piston 74. A series of three radially inwardly extending and circumferentially spaced apart pins 100 (only one of which is visible in FIG. 1B) are installed through the upper pin retainer 92, such that each of the pins engage one of three corresponding J-slots or ratchet paths 102 externally formed on a generally tubular axially extending upper ratchet 104. A series of four radially inwardly extending and circumferentially spaced apart pins 106 (only one of which is visible in FIG. 1D) are installed through the lower pin retainer 96, such that each of the pins engage one of four corresponding J-slots or ratchet paths 108 externally formed on a generally tubular axially extending lower ratchet 110.

Each of the upper and lower ratchets 104, 110 are externally rotatably disposed on the intermediate sleeve 54. The upper and lower ratchets 104, 110 are axially secured on the intermediate sleeve 54 between external shoulders 112 formed on the intermediate sleeve, and the upper sleeve 52 and lower sleeve 56, respectively. Thus, when the upper and lower pistons 68, 74 are axially displaced relative to the intermediate sleeve 54, the engagement of the pins 100, 106 in the corresponding ratchet paths 102, 108 in some instances cause the ratchets 104, 110 to rotate about the intermediate sleeve.

Figure 2:
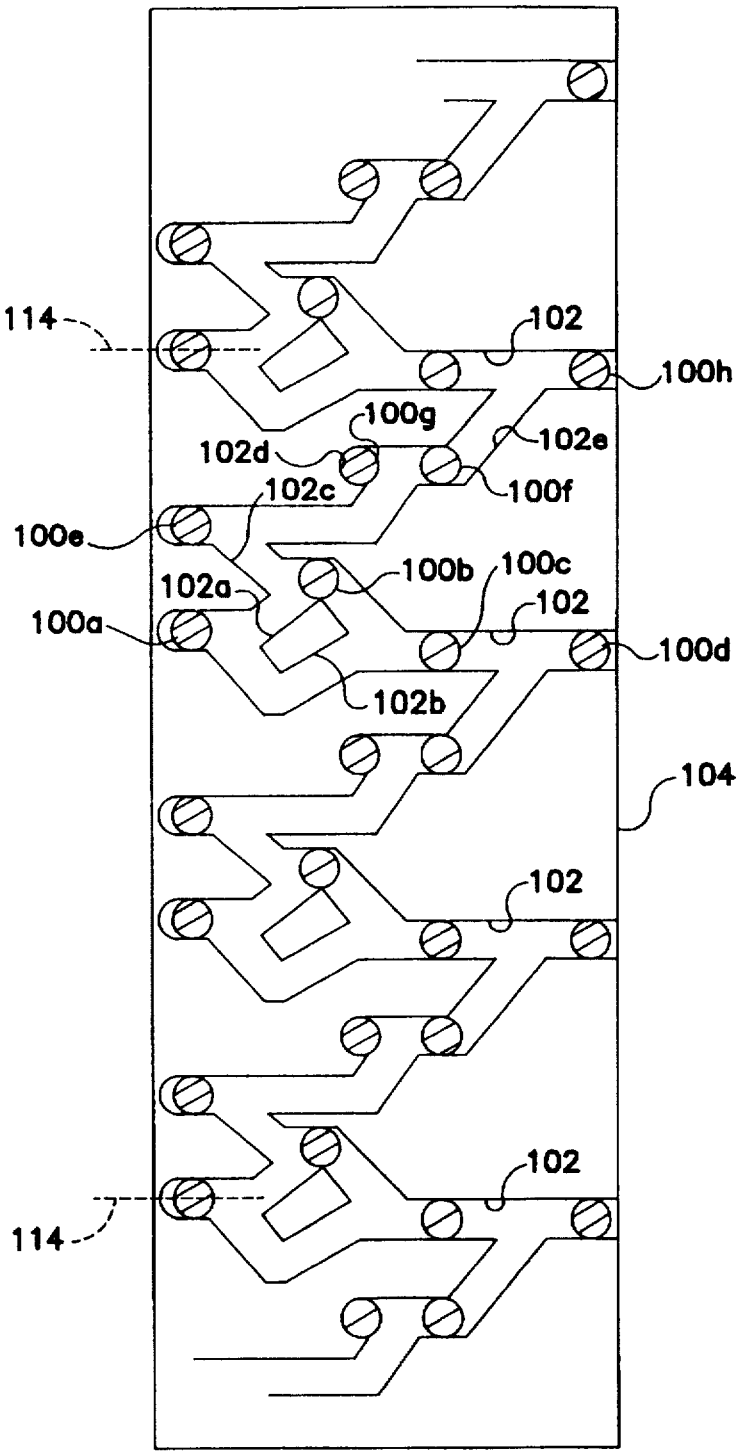
FIG. 2 is a circumferential view of a first ratchet sleeve of the valve actuating section of FIGS. 1A–1G, showing various dispositions of the first ratchet sleeve with respect to first pins received in corresponding ratchet paths formed on the first ratchet sleeve.

Referring additionally now to FIG. 2, a circumferential view of the upper ratchet 104 may be seen, the upper ratchet 104 being rotated 90 degrees for convenience of illustration, such that the upward direction is to the left of the figure. FIG. 2 shows the ratchet as if it has been "unrolled" from its normal generally cylindrical shape so that it is viewed from a two-dimensional perspective. For clarity of illustration and description, FIG. 2 shows the complete ratchet 104 between dashed lines 114 with the ratchet paths 102 continuing to either side thereof so that it does not appear that the paths are circumferentially discontinuous.

It is to be understood that it is not necessary for the upper ratchet 104 to have three ratchet paths 102 formed thereon. Other quantities of ratchet paths, and otherwise configured ratchet paths, may be utilized without departing from the principles of the present invention.

With the valve actuating section 12 in its configuration representatively illustrated in FIGS. 1A–1G, the pins 100 are disposed in the ratchet paths 102 in the position indicated by reference numeral 100*a*. For convenience of illustration and clarity of description, displacement of only one of the pins 100 in the ratchet paths 102 will be described herein, it being understood that each of the pins is likewise displaced, albeit in a circumferentially spaced apart relationship to the described pin displacement.

As the differential fluid pressure from the flow passage 18 to the annulus 26 is increased (by, for example, increasing a rate of circulation of fluids therethrough from the earth's surface), the upper piston 68, upper pin retainer 92, and pin 100 are biased axially downward by the differential fluid pressure as hereinabove described. Preferably, the spring 84 has a preload force, due to the spring being compressed when it is installed within the valve actuating section 12. Thus, a minimum differential fluid pressure is required to begin axially displacing the upper piston 68 downward. Preferably, the minimum differential fluid pressure is approximately 120 psi.

When the minimum differential fluid pressure is exceeded, the upper piston 68, upper pin retainer 92, and pin 100 will be thereby displaced axially downward relative to the ratchet 104. For convenience of description, hereinafter displacement of the pin 100 relative to the ratchet 104 will be described, it being understood that the upper piston 68 and upper pin retainer 92 are displaced along with the pin 100, and that they are displaced relative to the intermediate sleeve 54 as well.

Preferably, when the differential fluid pressure has reached approximately 150 psi, the pin 100 will be located at position 100*b* in the ratchet path 102, an inclined face 102*a* of the ratchet path having circumferentially displaced the ratchet 104 relative to the pin 100. At this point, a unique feature of the valve actuating section 12 stalls the pin 100 against further displacement in the ratchet path 102, so that a disproportionately greater differential fluid pressure is required to cause further displacement of the pin relative to the ratchet 104 than is necessary to overcome the upwardly biasing force of the spring 84.

Figure 1B:
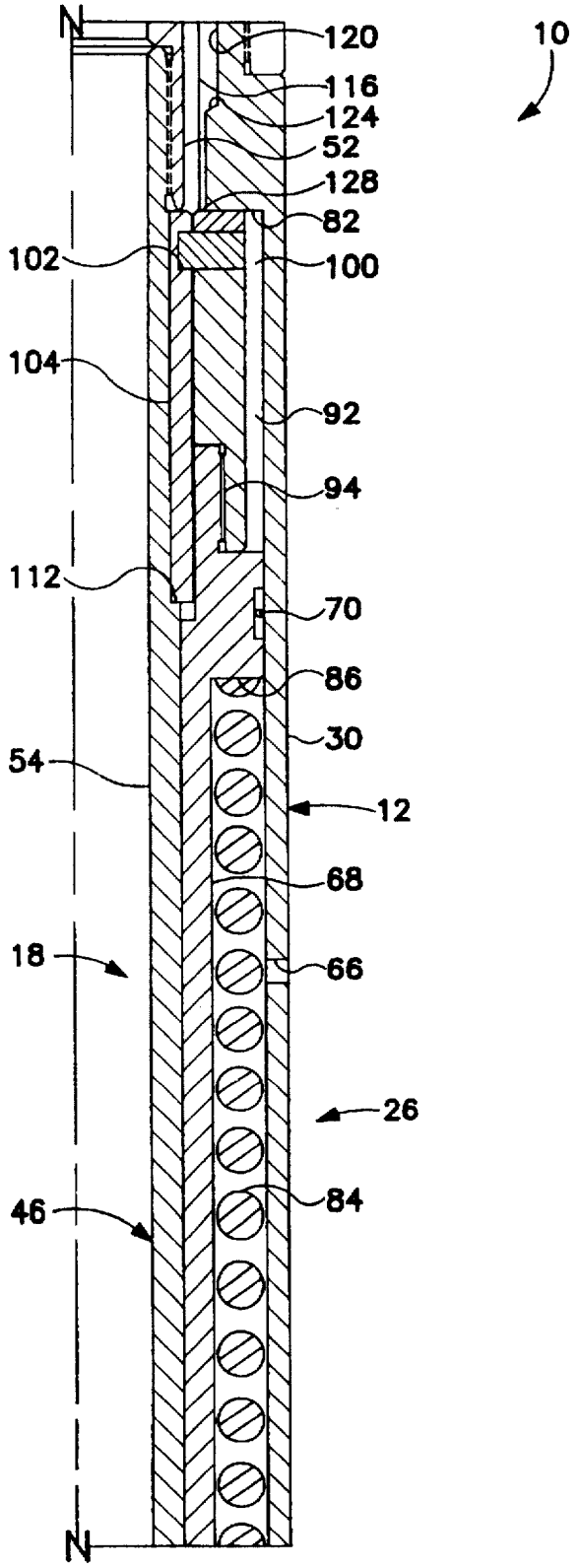
Figure 1D:
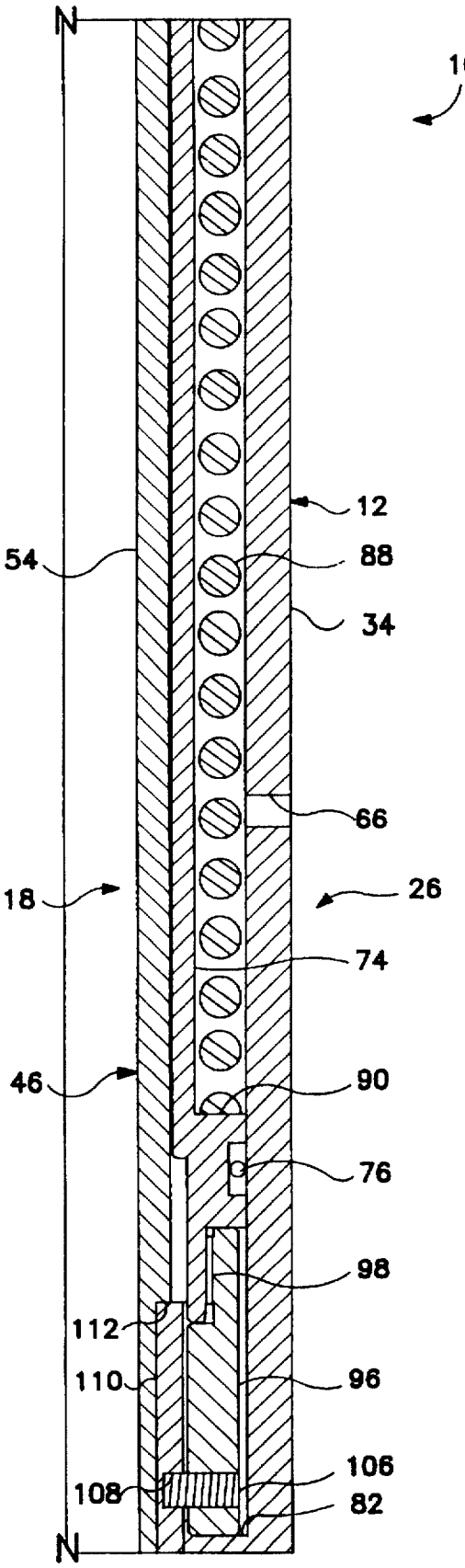

Referring specifically now to FIGS. 1A & 1B, it may be seen that the upper pin retainer 92 has an axially upwardly extending and generally tubular portion 116 formed thereon. The cylindrical portion 116 has a radially outwardly extending enlarged portion 118 formed thereon which is received within a correspondingly radially enlarged interior portion 120 of the upper housing 30. When the upper pin retainer 92 is axially downwardly displaced sufficiently relative to the upper housing 30, a downwardly facing radially inclined surface 122 formed on the radially enlarged portion 118 engages an upwardly facing radially inclined interior surface 124 formed on the upper housing 30. Preferably, the inclined surfaces 122, 124 are in axial engagement when the pin 100 is located at position 100*b* within the ratchet path 102.

The upper portion 116 of the pin retainer 92 is circumferentially divided into a plurality of axially extending segments 126, only one of which is visible in FIGS. 1A & 1B. Such circumferential division of the upper portion 116 may be accomplished by, for example, forming a series of circumferentially spaced apart and axially extending slots 128 (only one of which is visible in FIGS. 1A & 1B) through the upper portion. This circumferential division enables each of the segments 126 to be deflected radially inward by the engagement of the inclined surfaces 122, 124 when the differential fluid pressure exceeds a predetermined level, thereby permitting further displacement of the pin 100 relative to the ratchet 104.

Preferably, a differential fluid pressure of approximately 500 psi is required to radially inwardly deflect the radially enlarged portion 118 of the upper portion 116 to thereby enable the pin 100 to further displace in the ratchet path 102. Referring again to FIG. 2, the pin 100 is shown at a position 100*c* in the ratchet path 102, the position 100*c* corresponding to a differential fluid pressure of approximately 170 psi, however, since this pressure has already been exceeded at this point, no additional differential fluid pressure need be applied to displace the pin to position 100*c*. Thus, it may be seen that the pin 100 is preferably stalled at position 100*b* until the differential fluid pressure is increased sufficiently enough to radially inwardly compress the segments 126, enabling the pin 100 to continue to displace relative to the ratchet 104, such as to position 100*c* when the differential fluid pressure is approximately 500 psi.

It will be readily apparent to one of ordinary skill in the art that a differential fluid pressure of approximately 500–1,000 psi is typical in drilling operations wherein fluid, such as drilling mud, is circulated through a drill string. Therefore, it is seen that during normal drilling operations the differential fluid pressure is sufficient to cause the pin 100 to displace to position 100*c* within the ratchet path 102.

A subsequent reduction in the differential fluid pressure, such as frequently occurs when drilling operations are temporarily suspended to add additional drill pipe to the drill string at the earth's surface, will cause the pin 100 to displace axially upward relative to the ratchet 104. If the differential fluid pressure is decreased by a sufficient amount, the pin 100 will return to its initial position 100*a*. Thus, if the pin 100 is at position 100*c* during normal drilling operations and the fluid circulation is ceased, for example, to add drill pipe to the drill string, the pin will return to position 100*a*, an inclined face 102*b* of the ratchet path 102 preventing the pin 100 from retracing its path across position 100*b*.

Note that the radially enlarged portion 118 of the upper portion 116 has a gradually inclined upwardly facing surface 130 formed thereon. The gradually inclined surface 130 permits the radially enlarged portion 118 to easily re-enter the radially enlarged portion 120 of the upper housing 30 if the radially enlarged portion 118 is displaced axially downward past the internal shoulder 82.

It may now be clearly seen that the upper piston 68 is made to axially reciprocate within the upper housing 30 during normal drilling operations wherein the differential fluid pressure is typically increased to approximately 500–1,000 psi and then decreased to approximately 0 psi when drill pipe is added to the drill string. Additionally, it may be clearly seen that the inclined faces 102*a* and 102*b* of the ratchet path 102 cooperate to force the pin 100 to take a somewhat circular route within the ratchet path 102, from position 100*a* to position 100*b* and to position 100*c*, and then back to position 100*a* without again being at position 100*b*, during normal drilling operations.

A very different result is achieved if the differential fluid pressure is increased to displace the pin 100 from position 100*a* to position 100*b*, and then the differential fluid pressure is decreased without the pin being further displaced, for example, to position 100*c*. If the pin 100 is displaced from position 100*a* to position 100*b*, and then the differential fluid pressure is decreased by a sufficient amount, an inclined surface 102*c* of the ratchet path 102 will cause the pin to displace circumferentially relative to the ratchet 104, such that the pin is disposed at another position 100*e*.

As will be more fully appreciated by consideration of the further description of the valve actuating section 12 hereinbelow, the pin 100 is displaced to position 100*e* when it is desired to close the valve portion 16. Thus, during normal drilling operations the differential fluid pressure in typically increased to approximately 500–1,000 psi and intermittently decreased to approximately 0 psi, causing the pin loo to cycle between successive positions 100*a*, 100*b*, and 100*c*. However, when it is desired to close the valve portion 16, such as when it is desired to perform a test on a formation intersected by the wellbore, the differential fluid pressure is increased to approximately 300 psi and then decreased to approximately 0 psi, thereby displacing the pin 100 to position 100*e*.

With the pin 100 disposed at position 100*e*, the differential fluid pressure may be increased to approximately 500–1,000 psi to displace the pin relative to the ratchet 104, so that the pin is disposed at position 100*f*. Reducing the differential fluid pressure somewhat (to approximately 150 psi) will then cause the pin 100 to be displaced to position 100*g*.

Note that, at position 100*g*, the pin 100 is axially retained by a face 102*d* of the ratchet path 102. The face 102*d* is contoured to receive the pin 100 therein so that, as the differential fluid pressure is further reduced, the pin is unable to displace from the position 100*g*.

It will be readily apparent to one of ordinary skill in the art that, with the pin 100 in position 100*g*, as the differential fluid pressure is further reduced, the axially upwardly biasing force of the spring 84 will eventually become greater than the downward force resulting from the differential fluid pressure acting on the differential area of the upper piston 68. When the upwardly biasing force of the spring 84 is greater than the axially downward force exerted by the upper piston 68, the pin 100 (which is secured to the upper piston as hereinabove described) will be forced upwardly against the face 102*d*, thereby applying an axially upwardly directed force to the upper ratchet 104.

Since the upper ratchet 104 is axially secured to the intermediate sleeve 54 as hereinabove described, the upwardly directed force applied to the upper ratchet is transferred to the intermediate sleeve and, thereby, to the inner mandrel assembly 46. The inner mandrel assembly 46 displaces axially upward in response to the upwardly directed force being applied thereto. As will be more fully described hereinbelow, such axially upward displacement of the inner mandrel assembly 46 relative to the substantial remainder of the valve actuating section 12 acts to close the valve portion 16. Referring momentarily to FIGS. 4A–4G, the valve actuating section 12 is shown with the inner mandrel assembly 46 shifted upward and the valve portion 16 in its closed configuration.

Thus, it may be clearly seen that the valve portion 16 is closed upon a decrease in the differential fluid pressure. In the illustrated preferred embodiment, such closing of the valve portion 16 occurs when the differential fluid pressure has been decreased to approximately 0 psi.

Figure 3:
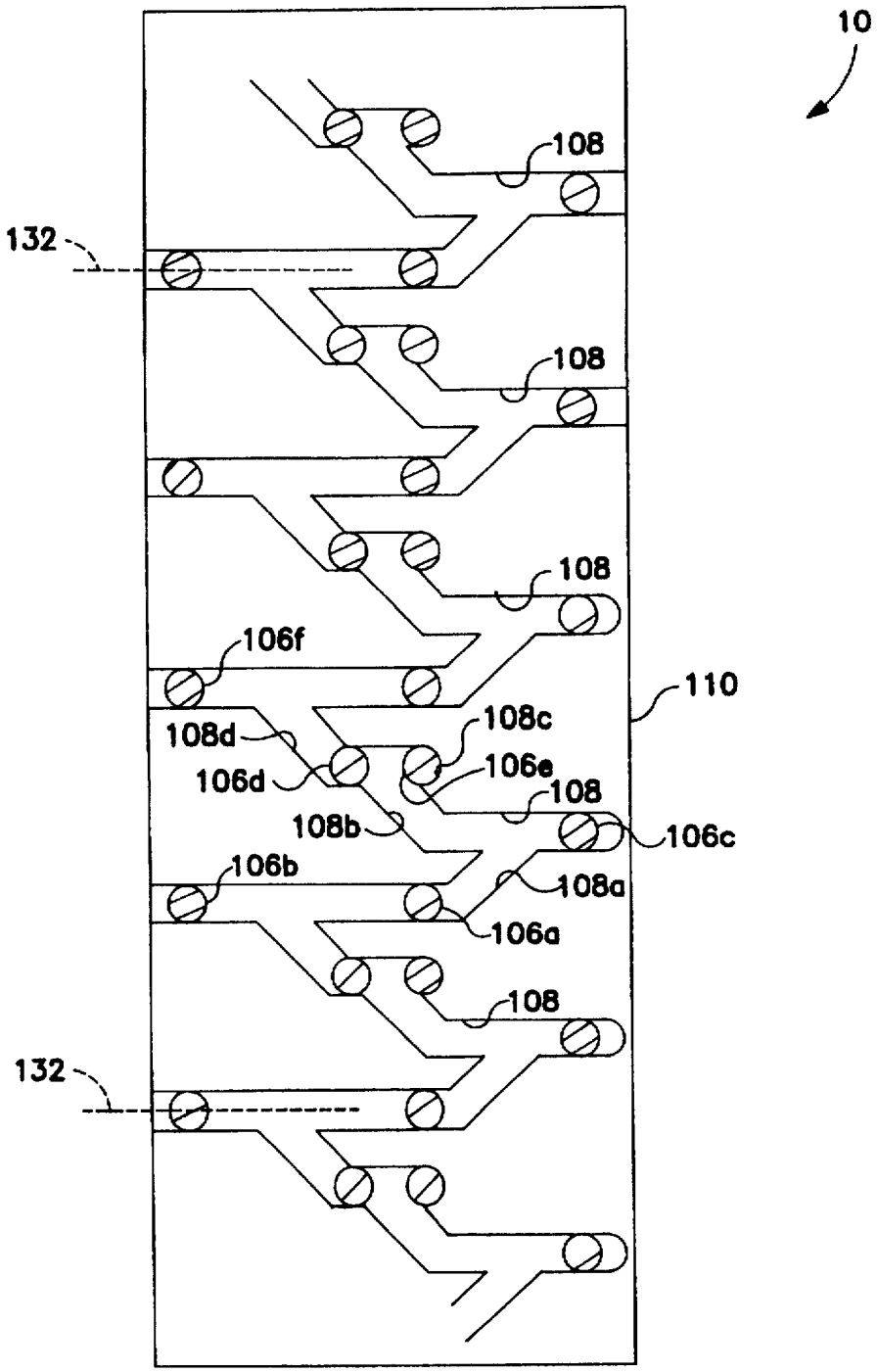
FIG. 3 is a circumferential view of a second ratchet sleeve of the valve actuating section of FIGS. 1A–1G, showing various dispositions of the second ratchet sleeve with respect to second pins received in corresponding ratchet paths formed on the second ratchet sleeve.

Referring additionally now to FIG. 3, a circumferential view of the lower ratchet 110 may be seen, the lower ratchet being rotated 90 degrees for convenience of illustration, such that the upward direction is to the left of the figure. FIG. 3 shows the ratchet as if it has been "unrolled" from its normal generally cylindrical shape so that it is viewed from a two-dimensional perspective. For clarity of illustration and description, FIG. 3 shows the complete ratchet 110 between dashed lines 132 with the ratchet paths 108 continuing to either side thereof so that it does not appear that the paths are circumferentially discontinuous.

It is to be understood that it is not necessary for the upper ratchet 110 to have four ratchet paths 108 formed thereon. Other quantities of ratchet paths, and otherwise configured ratchet paths, may be utilized without departing from the principles of the present invention.

With the valve actuating section 12 in its configuration representatively illustrated in FIGS. 1A–1G, the pins 106 are disposed in the ratchet paths 108 in the position indicated by reference numeral 106a. For convenience of illustration and clarity of description, displacement of only one of the pins 106 in the ratchet paths 108 will be described herein, it being understood that each of the pins is likewise displaced, albeit in a circumferentially spaced apart relationship to the described pin displacement.

As the differential fluid pressure from the flow passage 18 to the annulus 26 is increased (by, for example, increasing a rate of circulation of fluids therethrough from the earth's surface), the lower piston 74, lower pin retainer 96, and pin 106 are biased axially upward by the differential fluid pressure as hereinabove described. Preferably, the spring 88 has a preload force, due to the spring being compressed when it is installed within the valve actuating section 12. Thus, a minimum differential fluid pressure is required to begin axially displacing the lower piston 74 upward. Preferably, the minimum differential fluid pressure is approximately 120 psi.

When the minimum differential fluid pressure is exceeded, the lower piston 74, lower pin retainer 96, and pin 106 will be thereby displaced axially upward relative to the ratchet 110. For convenience of description, hereinafter displacement of the pin 106 relative to the ratchet 110 will be described, it being understood that the lower piston 74 and lower pin retainer 96 are displaced along with the pin 106, and that they are displaced relative to the intermediate sleeve 54 as well.

As more fully described hereinabove, a differential fluid pressure of approximately 500–1,000 psi is typical in drilling operations wherein fluid, such as drilling mud, is circulated through the drill string. Therefore, it may be seen that during normal drilling operations the differential fluid pressure is sufficient to cause the pin 106 to displace to position 106b within the ratchet path 108. A subsequent reduction in the differential fluid pressure, such as frequently occurs when drilling operations are temporarily suspended to add additional drill pipe to the drill string at the earth's surface, will cause the pin 106 to displace axially downward relative to the ratchet 110. If the differential fluid pressure is decreased by a sufficient amount, the pin 106 will return to its initial position 106a. Thus, if the pin 106 is at position 106b during normal drilling operations and the fluid circulation is ceased, for example, to add drill pipe to the drill string, the pin will return to position 106a.

It may now be clearly seen that the lower piston 74 is made to axially reciprocate within the lower housing 34 during normal drilling operations wherein the differential fluid pressure is typically increased to approximately 500–1,000 psi and then decreased to approximately 0 psi when drill pipe is added to the drill string. Additionally, it may be clearly seen that the pin 106 also axially reciprocates from position 106a to position 106b, and then back to position 106a during normal drilling operations.

However, when the inner mandrel assembly 46 is axially upwardly displaced as more fully described hereinabove, the pin 106 is displaced within the ratchet path 108 to position 106c, an inclined face 108a circumferentially displacing the pin relative to the ratchet 110. Thus, when the valve portion 16 is closed by the axially upward displacement of the inner mandrel assembly 46, and the differential fluid pressure has been reduced to approximately 0 psi, pin 106 is disposed at position 106c and pin 100 is disposed at position 100g. At this point, the valve actuating section 12 will be in its closed configuration as representatively illustrated in FIGS. 4A–4G. It will be readily apparent to one of ordinary skill in the art upon careful consideration of the description of the valve actuating section 12 hereinabove, and the further description thereof hereinbelow, that such closed configuration of the valve actuating section places the formation testing system 10 in a configuration in which a formation intersected by the wellbore in which the formation testing system is disposed may be advantageously tested.

Figure 1E:
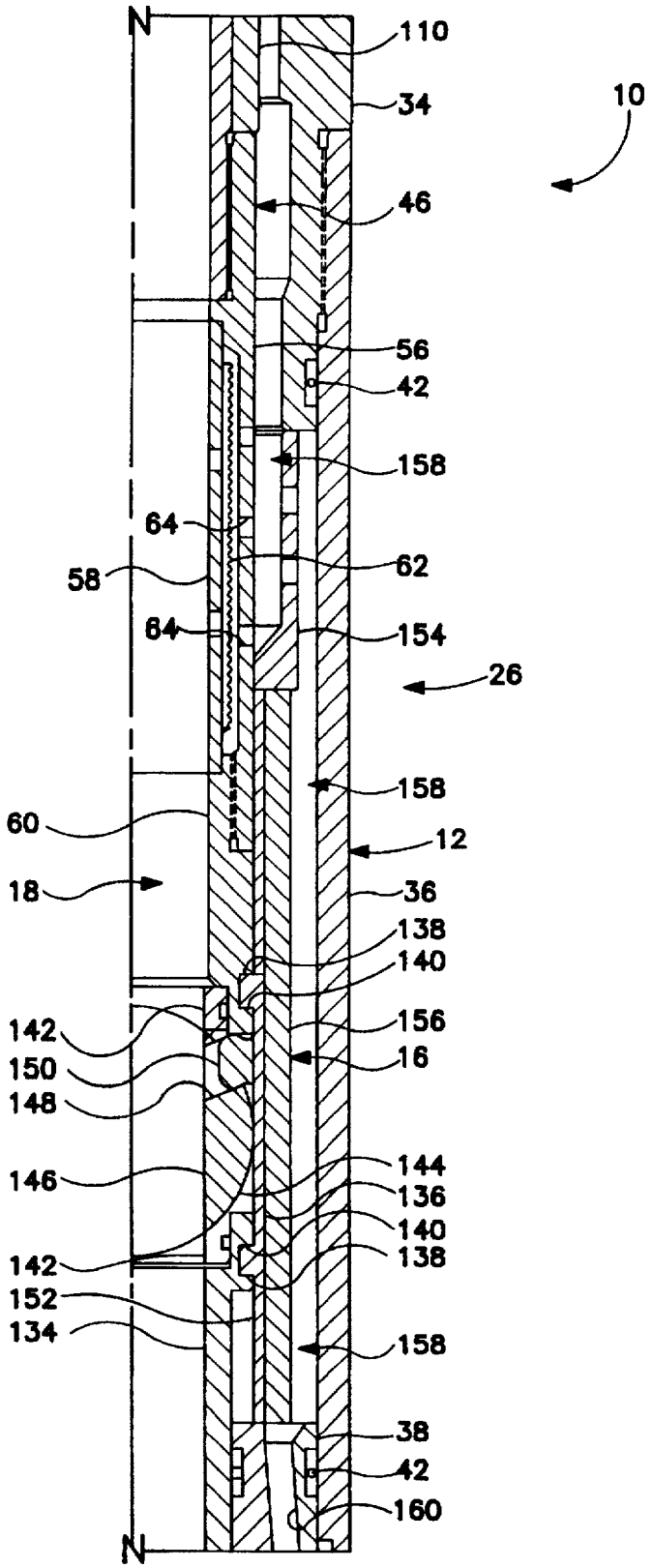

The upper ball retainer 60 is axially secured to an axially extending generally tubular lower ball retainer 134 by means of a circumferentially spaced apart series of generally C-shaped links 136 (only one of which is visible in FIG. 1E). Radially inwardly projecting end portions 138 formed on each of the links 136 are received in complementarily shaped grooves 140 formed on each of the upper and lower ball retainers 60, 134 for this purpose. A ball seat 142 of conventional design is axially slidingly and sealingly received in each of the upper and lower ball retainers 60, 134. The ball seats 142 also sealingly engage a ball 144, which has an opening 146 formed axially therethrough. As viewed in FIG. 1E, with the valve portion 16 in its open configuration, the flow passage 18 extends axially through the opening 146.

Figure 4A:
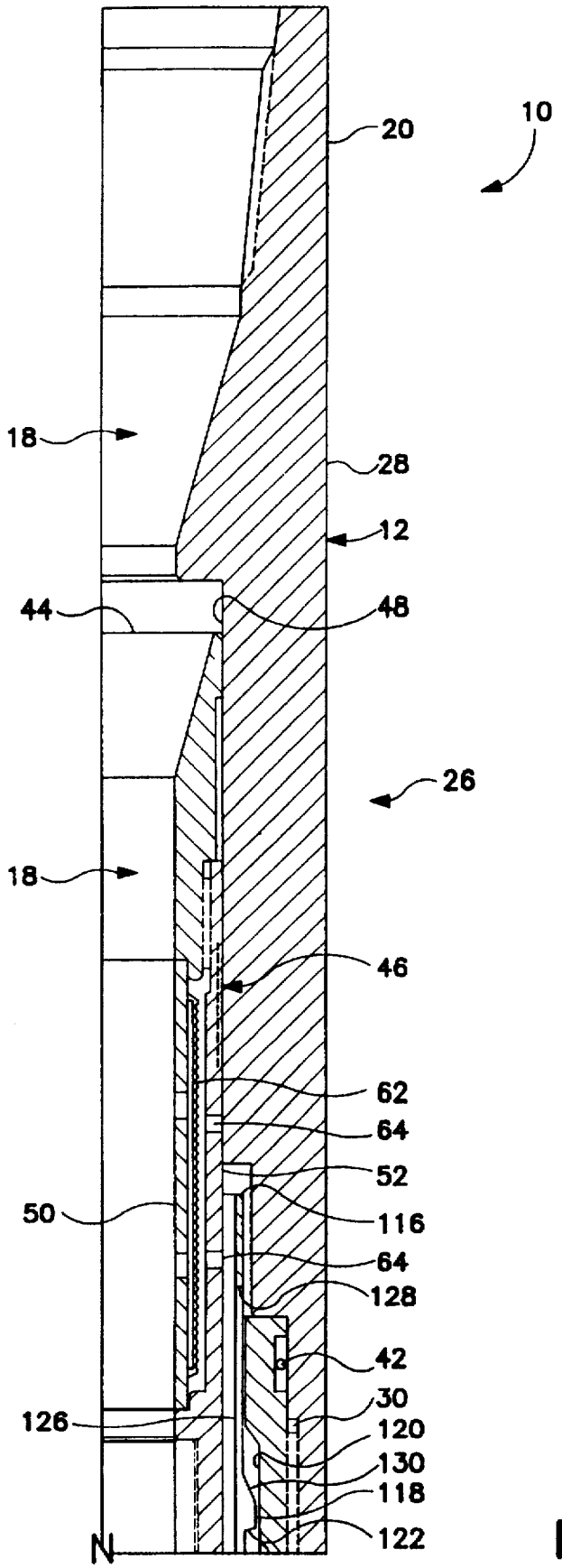
Figure 4B:
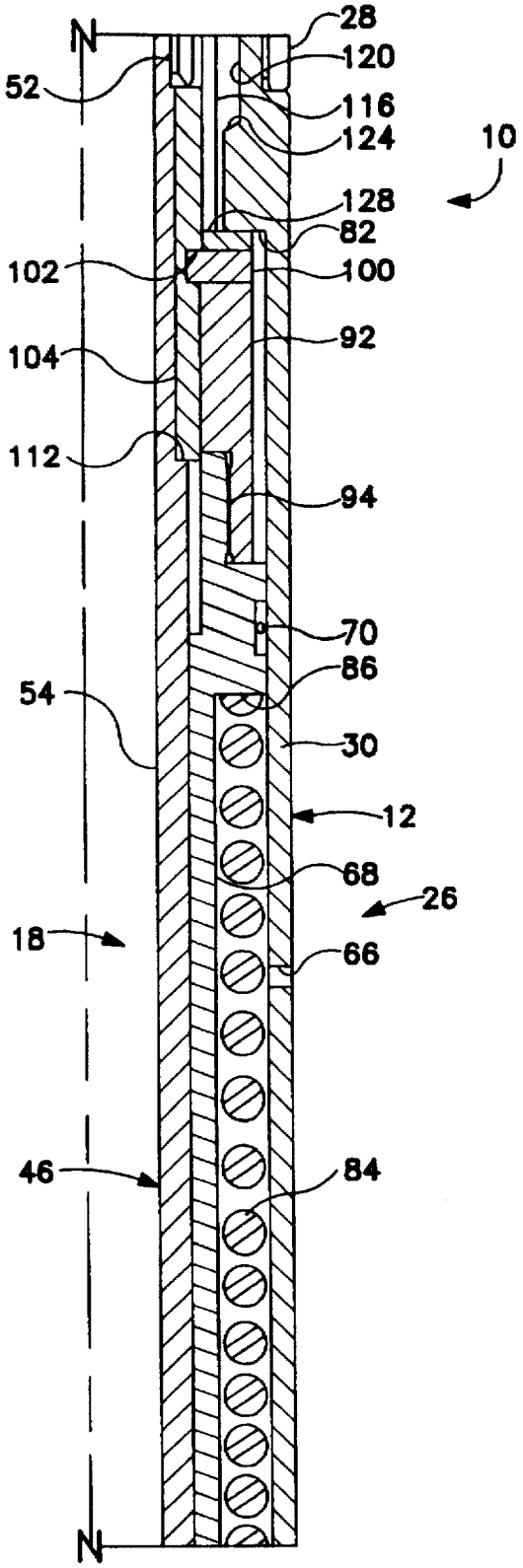
Figure 4C:
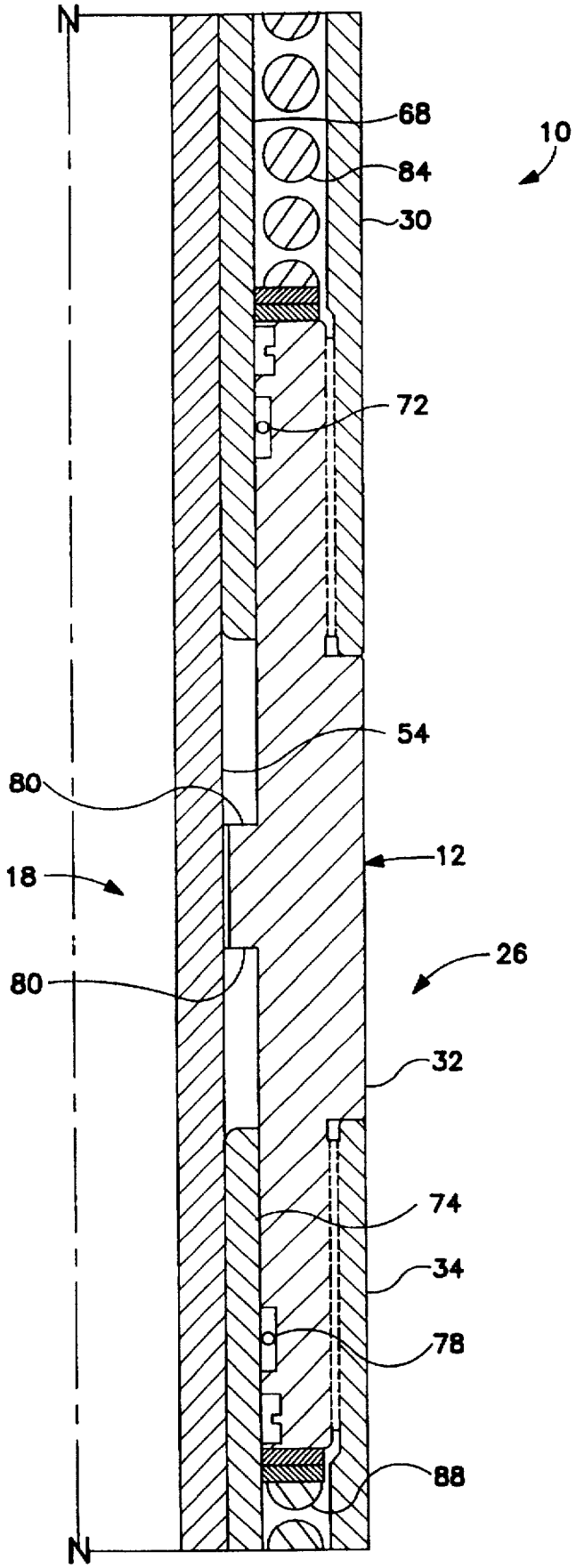
Figure 4D:
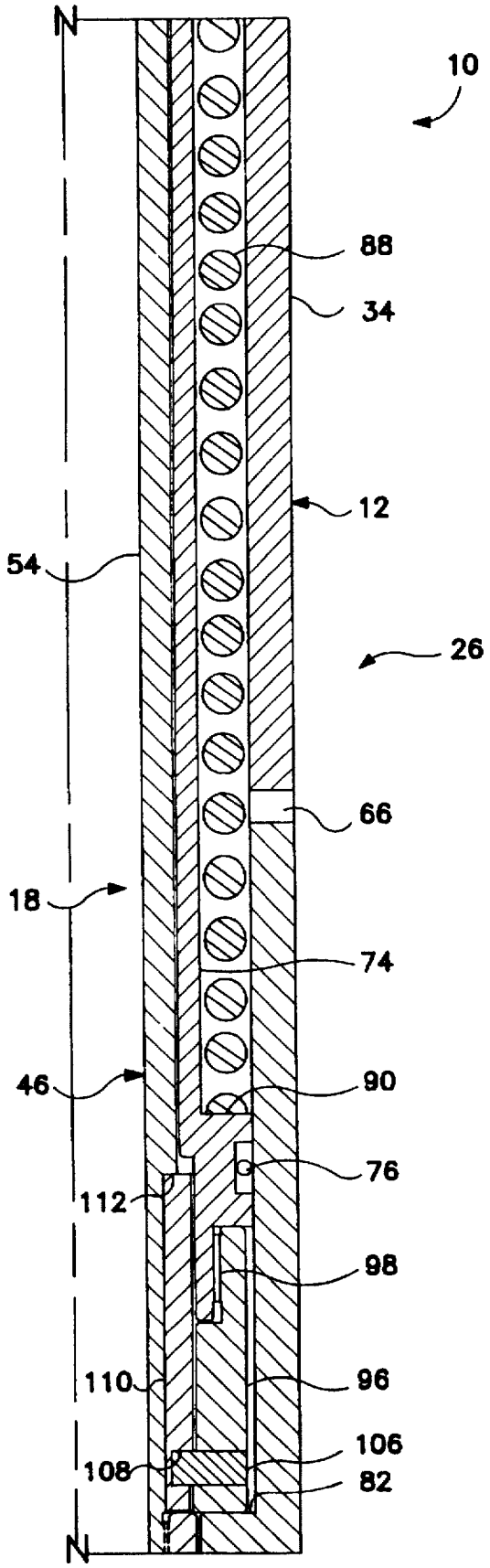
Figure 4E:
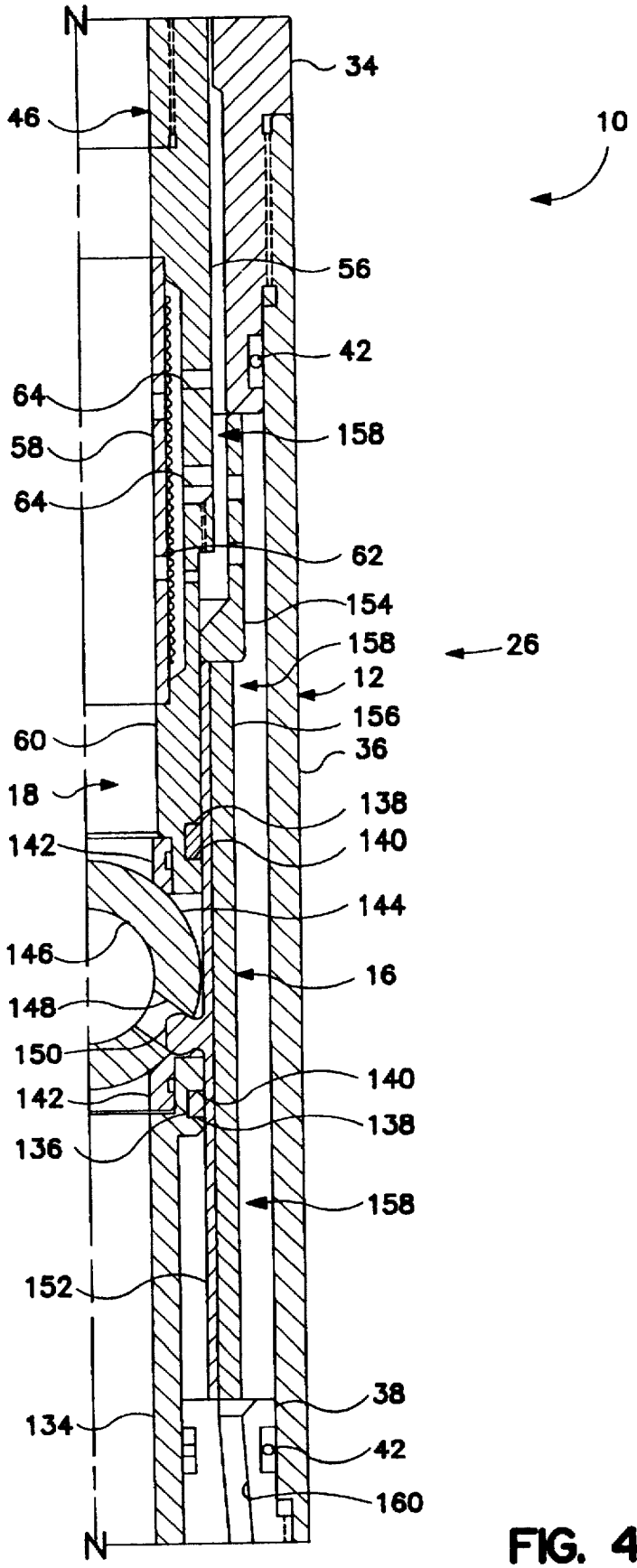

Two eccentrically extending openings 148 are formed through the ball 144 (only one of which is visible in FIG. 1E). The openings 148 are utilized, in a manner that is more fully described hereinbelow, to rotate the ball 144 about an axis perpendicular to the opening 146, in order to isolate the opening 146 from the flow passage 18 and, thereby, close the valve portion 16. FIG. 4E shows the ball 144 rotated about its axis, the opening 146 being in fluid isolation from the flow passage 18 by sealing engagement of the ball seats 142 with the ball.

A lug 150 (only one of which is visible in FIG. 1E) is received in each of the openings 148. Each of the lugs 150 projects inwardly from an axially extending lug member 152. The relationship of the lugs 150 to the lug members 152 may be more clearly seen in FIG. 4E. The links 136 and lug members 152 are disposed circumferentially about the ball 144 and ball retainers 60, 134. Due to the eccentric placement of the openings 148, the lug members 152 displace somewhat circumferentially when the ball 144 is rotated, the lugs 150 being retained in the openings 148 as the ball rotates.

When the inner mandrel assembly 46 is displaced axially upward as hereinabove described, the upper ball retainer 60, links 136, lower ball retainer 134, ball 144, and ball seats 142 are also displaced therewith. The lug member 152, however, remains axially stationary with respect to the remainder of the valve actuating section 12. This is due to the fact that the lug member 152 is axially retained between an axially extending generally tubular ported member 154 and the operator housing 38. It is the relative axial displacement between the ball 144 and the lug member 152 when the inner mandrel assembly 46 is axially displaced that causes the ball to rotate about its axis.

An axially extending and generally tubular outer sleeve 156 radially inwardly retains the lug members 152 and links 136. The outer sleeve 156 is axially retained between the ported member 154 and the operator housing 38. The outer sleeve 156 maintains the lug 150 in cooperative engagement with the opening 148, and maintains the links 136 in cooperative engagement with the ball retainers 60, 134.

With the valve actuating section 12 in its open configuration as shown in FIGS. 1A–1G, an outer inflation flow passage 158 formed therein is in a vented configuration. Conversely, when the valve actuating section 12 is in its closed configuration as shown in FIGS. 4A–4G, the inflation flow passage 158 is in a bypass configuration, permitting fluid pressure in a portion of the flow passage 18 above the ball 144 to be transmitted through the inflation flow passage 158 to the fluid sampling section 14 for inflation of inflatable packers disposed thereon.

The lower ported sleeve 58 and lower sleeve 56 permit fluid communication radially therethrough between the flow passage 18 and the inflation flow passage 158. Note that such fluid communication also permits fluid pressure in the flow passage 18 to be applied to the lower piston 74. Fluid communication is also permitted radially through the ported member 154. From the ported member 154 the inflation flow passage 158 extends axially downward radially between the valve portion 16 and the valve housing 36.

A generally axially extending opening 160 formed through the operator housing 38 permits fluid communication of the inflation flow passage 158 to the lower connector 40. A generally axially extending opening 162 formed partially through the lower connector 40 permits fluid communication of the inflation flow passage 158 to a location between circumferential seals 164 externally disposed on the lower connector (see FIGS. IF & 1G).

An axially extending generally tubular shuttle 166 is threadedly attached to the lower ball retainer 134 and is axially slidingly disposed within the operator housing 38 and the lower connector 40. A circumferential seal 168 externally carried on the shuttle 166 sealingly engages an axially extending bore 170 internally formed on the operator housing 38. A series of three axially spaced apart circumferential seals 172, 174, and 176 are carried internally on the lower connector 40 and sealingly engage the shuttle 166 in a manner that will be more fully described hereinbelow.

Figure 1F:
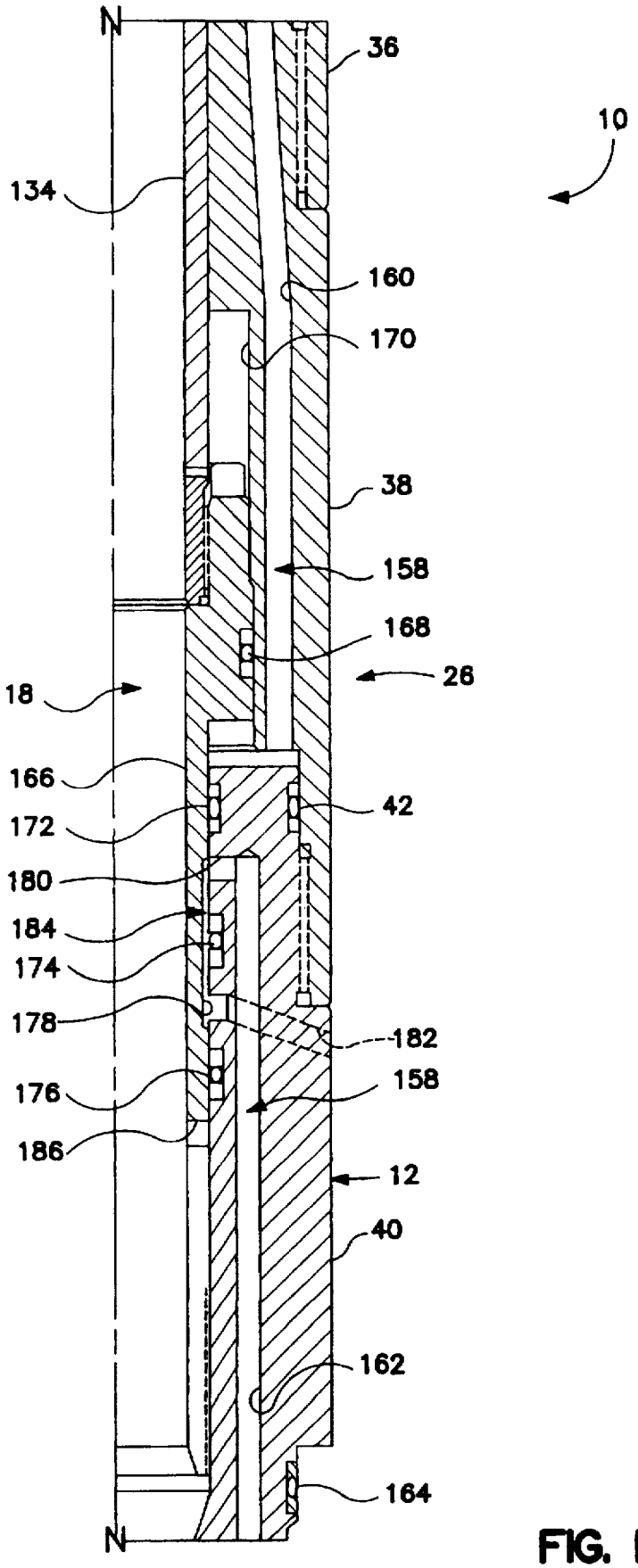
Figure 1G:
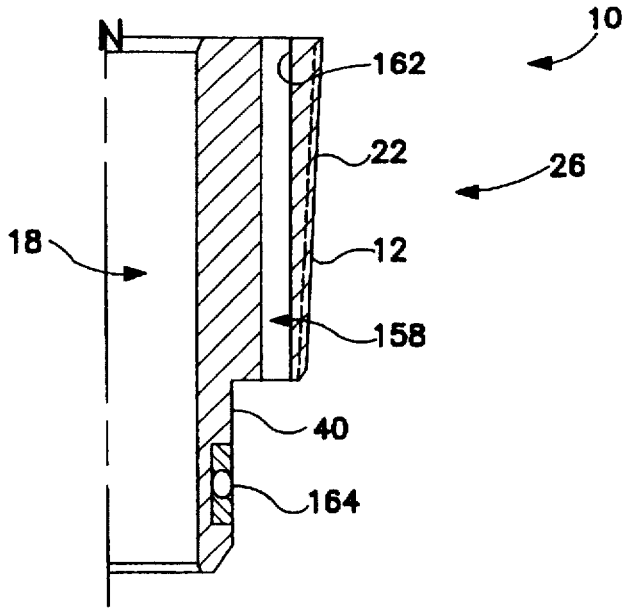
Figure 4G:
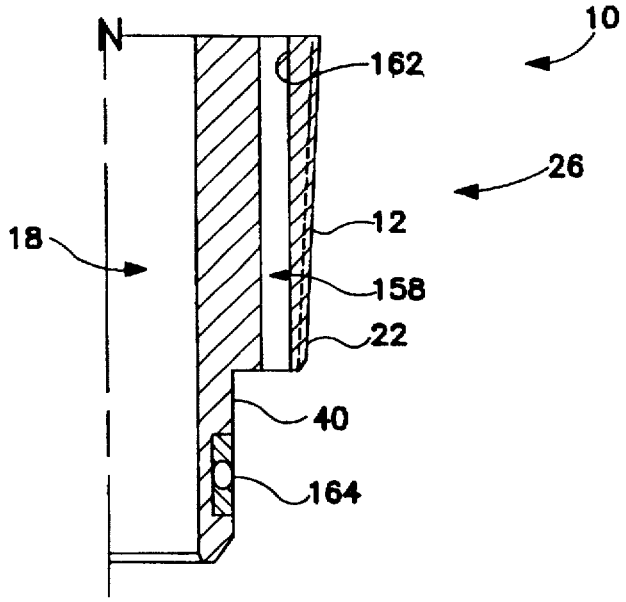
FIGS. 4A–4G are quarter-sectional views of successive axial portions of the valve actuating section of FIGS. 1A–1G, the valve actuating section being shown in a configuration in which the valve is closed.

With the valve actuating section 12 in its open configuration as shown in FIGS. 1A–1G, seals 172 and 176 sealingly engage the shuttle 166 as shown in FIG. 1F. The seal 174 does not sealingly engage the shuttle 166 due to a radially reduced portion 178 externally formed on the shuttle being disposed radially opposite the seal 174. Note that the radially reduced portion 178 may also be a series of circumferentially spaced apart and axially extending grooves formed on the shuttle 166. Such lack of sealing engagement of the seal 174 with the shuttle 166 permits fluid communication between the annulus 26 and the inflation flow passage 158 via openings 180 and 182 formed in the lower connector 40. Opening 180 provides fluid communication from the inflation flow passage 158 to an annular area 184 radially between the radially reduced portion 178 and the lower connector 40, and opening 182 provides fluid communication from the annular area 184 to the annulus 26. However, sealing engagement between the seal 172 and the shuttle 166 prevents fluid communication between the inflation flow passage 158 in the operator housing 38 and the annular area 184.

Venting of the inflation flow passage 158 to the annulus 26, as shown in FIG. 1F, ensures that when the valve portion 16 is open, the inflatable packers (described hereinbelow) are not inflated. When it is desired to inflate the inflatable packers, the valve portion 16 is closed as shown in FIGS. 4A–4G and more fully described hereinabove, and the inflation flow passage 158 in the lower connector 40 is placed in fluid communication with the inflation flow passage in the operator housing 38.

Figure 4F:
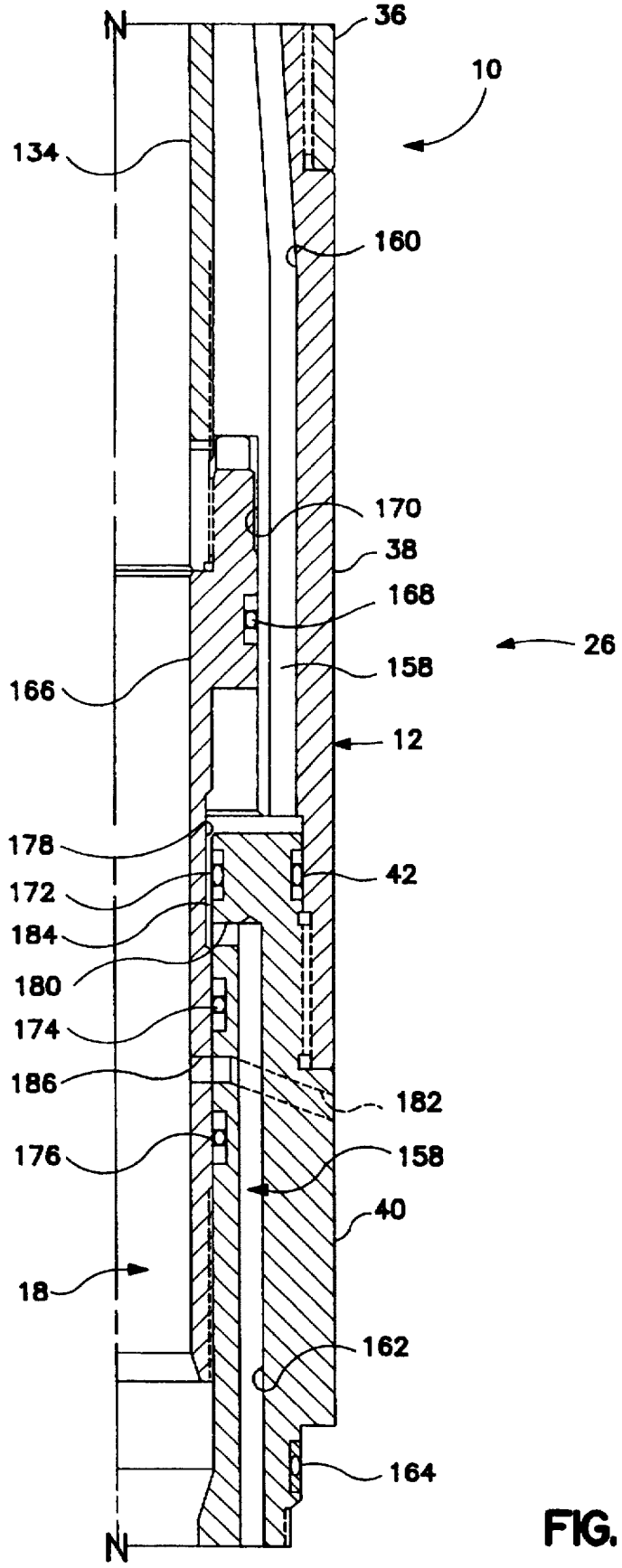

As described hereinabove, when the valve portion 16 is closed, the inner mandrel assembly 46 is displaced axially upward. Since the lower ball retainer 134 is axially secured to the shuttle 166, the shuttle will also be displaced axially upward when the inner mandrel assembly 46 is displaced axially upward. FIG. 4F shows the shuttle 166 in its axially upwardly displaced position.

When the shuttle 166 is axially upwardly displaced, as shown in FIG. 4F, seals 174 and 176 sealingly engage the shuttle, but seal 172 does not. This is due to the fact that the annular area 184 is now disposed radially opposite the seal 172. In this configuration, fluid communication is permitted between the inflation flow passage in the operator housing 38 and the inflation flow passage in the lower connector 40. The portion of flow passage 18 below the ball 144 is vented to the annulus 26 via a radially extending opening 186 formed through the shuttle 166.

Thus, it may be clearly seen that when the valve actuating section 12 is in its open configuration as representatively illustrated in FIGS. 1A–1G, the valve portion 16 is open, thereby permitting fluid communication therethrough in the flow passage 18, and the inflation flow passage 158 is in its vented configuration, the inflation flow passage being vented to the annulus 26 through the lower connector 40. When the valve actuating section 12 is in its closed configuration as representatively illustrated in FIGS. 4A–4G, the valve portion 16 is closed, thereby preventing fluid communication therethrough in the flow passage 18, and the inflation flow passage 158 is in its bypass configuration, fluid communication in the inflation flow passage being permitted from the flow passage 18 axially upward from the ball 144 to the inflation flow passage in the lower connector 40.

As is more fully described hereinbelow, fluid pressure in the inflation flow passage 158 is utilized to inflate inflatable packers carried on the fluid sampling section 14. For this purpose, an inflation fluid pressure (approximately 1,000 psi differential from the interior of the drill string to the annulus 26) is applied to the drill string at the earth's surface after the valve actuating section 12 has been configured in its closed configuration. That inflation fluid pressure is received in the flow passage 18 and transmitted via the inflation flow passage 158 to the lower connector 40.

Referring again to FIGS. 2 & 3, when the inflation fluid pressure is received in the flow passage 18, the upper piston 68 will be thereby urged axially downward and the lower piston 74 will be thereby urged axially upward. In the illustrated preferred embodiment, the inflation fluid pressure is sufficient to overcome the biasing forces of the springs 84, 88, resulting in axially downward displacement of the upper piston 68 and axially upward displacement of the lower piston 74. Accordingly, pin 100 is correspondingly displaced from position 100g to position **100*h*, an inclined face 102*e* of the ratchet path 102 circumferentially displacing the pin 100 as well. Note that the position 100*h* is the same as position 100*d*, simply displaced circumferentially by one of the ratchet paths 102. For this purpose, the three ratchet paths 102 actually form one continuous path, the pins 100 merely advancing from one ratchet path to the next as the valve actuating section 12** is subjected to various differential fluid pressures.

The axially upward displacement of the lower piston 74 due to the inflation fluid pressure also causes the pin 106 to displace from position **106*c* to position 106*d*, an inclined face 108*b* of the ratchet path 108 circumferentially displacing the pin relative to the ratchet 110** as well.

When it is no longer desired to inflate the inflatable packers, such as when the formation intersected by the wellbore has been sufficiently tested by operation of the fluid sampling section 14 as more fully described hereinbelow, the inflation fluid pressure is released from the drill string and the flow passage 18 above the ball 144. The differential fluid pressure thus being reduced to approximately 0 psi, the springs 84, 88 will bias the upper piston 68 axially upward and the lower piston 74 axially downward. The pin 100 will return to position 100*a* from position 100*h*, albeit in the next successive ratchet path 102, thus ready for continuation of normal drilling operations as described hereinabove. However, pin 106 will be displaced axially downward relative to the ratchet 110 and will be retained at position 106*e* by a complementarily shaped face 108*c* of the ratchet path 108.

As the differential fluid pressure is decreased, the downwardly biasing force exerted by the spring 88 eventually overcomes the upwardly directed force of the lower piston 74. The pin 106, being axially secured to the lower piston 74 as hereinabove described, will accordingly exert an axially downwardly directed force on the face 108*c* and, thus, on the ratchet 110. Since the ratchet 110 is axially secured to the inner mandrel assembly 46 as described hereinabove, the inner mandrel assembly will be thereby displaced axially downward. This axial displacement of the inner mandrel assembly 46 is similar to the previously described displacement of the inner mandrel assembly when the pin 100 engages the face 102*d* of the ratchet path 102, except that it is oppositely directed. However, as with the previously described axially upward displacement of the inner mandrel assembly 46, the axially downward displacement of the inner mandrel assembly also occurs upon a decrease of the differential fluid pressure.

When the differential fluid pressure is decreased sufficiently, the spring 88 will displace the inner mandrel assembly 46 axially downward so that the valve actuating section 12 resumes its open configuration as shown in FIGS. 1A–1G. When a sufficient subsequent increase in the differential fluid pressure is achieved, such as when normal drilling operations are resumed and the differential fluid pressure is increased to approximately 500–1,000 psi due to, for example, circulation of drilling mud through the flow passage 18, the pin 106 will be axially upwardly displaced relative to the ratchet 110 from position 106*e* to position 106*f*, an inclined face 108*d* of the ratchet path 108 circumferentially displacing the pin relative to the ratchet 110 as well. Note that position 106*f* is similar to position 106*b*, but is disposed in the next successive ratchet path 108. Thus, as with the pins 100, the pins 106 are displaced between successive ratchet paths 108, the ratchet paths actually forming a continuous path circumferentially about the ratchet 110.

It is to be clearly understood that the various fluid pressures and differential fluid pressures described hereinabove for producing various responses, displacements, etc. of and among various elements of the valve actuating section 12 have been given for purposes of describing an exemplary operation of the valve operating section. Modifications may be easily made to the valve operating section 12, such as by substituting another biasing member for one or both of the springs 84, 88, by changing configurations of the ratchets 104, 110, by changing a spring rate and/or preload force in one or both of the springs, or by changing differential pressure areas of the pistons 68, 74, to alter corresponding fluid pressures and differential fluid pressures. Modifications such as these are within the level of skill of a person of ordinary skill in the art and are encompassed by the principles of the present invention.

Referring additionally now to FIGS. 5A–5F, 6, 7, 8, and 9A–9F, the fluid sampling section 14 is representatively illustrated. As described hereinabove, an upper end 24 of the fluid sampling section 14 is threadedly connectable directly to the lower end 22 of the valve actuating section 12. When so connected, each of the seals 164 carried on the lower connector 40 sealingly engage one of two axially extending bores 188 internally formed on an axially extending generally tubular upper connector 190 of the fluid sampling section.

It is to be understood that it is not necessary for the lower connector 40 to be connected directly to the upper connector 190 according to the principles of the present invention. For example, another tubular member (not shown) could be interconnected axially between the lower connector 40 and the upper connector 190. For this purpose, the tubular member may be provided with a lower end similar to the lower end 22, an upper end similar to the upper end 24, a flow passage permitting fluid communication with the flow passage 18, and an inflation flow passage permitting fluid communication with the inflation flow passage 158. In this manner, the fluid sampling section 14 and valve actuating section 12 may be axially spaced apart from one another as desired.

As a further example, the tubular member may be of the type which is designed to axially separate upon application of a sufficient axial tensile force thereto. In this manner, the drill string above the tubular member, including the valve actuating section 12 could be retrieved from the wellbore in the event that the fluid sampling section 14 or other portion of the drill string therebelow became stuck in the wellbore. The following description of the fluid sampling section 14 assumes that the fluid sampling section is directly connected to the valve actuating section 12, it being understood that they may actually be axially separated depending upon whether additional members are interconnected therebetween.

When the lower end 22 is cooperatively engaged with the upper end 24, seals 164 sealingly engaging bores 188, the flow passage 18 extends axially through the fluid sampling section 14 and the inflation flow passage 158 extends axially into the fluid sampling section. Therefore, when the flow passage 18 in the valve actuating section 12 below the ball 144 is subjected to fluid pressure or is vented to the annulus 26 as described hereinabove, the same occurs for the flow passage 18 in the fluid sampling section 14. Likewise, when the inflation flow passage 158 in the valve actuating section 12 below the operator housing 38 is subjected to fluid pressure or is vented to the annulus 26 as described hereinabove, the same occurs for the inflation flow passage in the fluid sampling section 14.

Therefore, with the valve actuating section 12 in its open configuration as shown in FIGS. 1A–1G, the inflation flow passage 158 in the fluid sampling section 14 is vented to the annulus 26 and the flow passage 18 in the fluid sampling section is in fluid communication with the interior of the drill string above the valve actuating section. With the valve actuating section 12 in its closed configuration as shown in FIGS. 4A–4G, the inflation flow passage 158 in the fluid sampling section 14 is in fluid communication with the interior of the drill string above the valve actuating section and the flow passage 18 in the fluid sampling section is vented to the annulus 26. Thus, it may be clearly seen that, with the valve actuating section 12 in its closed configuration, fluid pressure may be applied to the interior of the drill string at the earth's surface and that fluid pressure will be transmitted to the inflation flow passage 158 in the fluid sampling section 14.

Figure 5A:
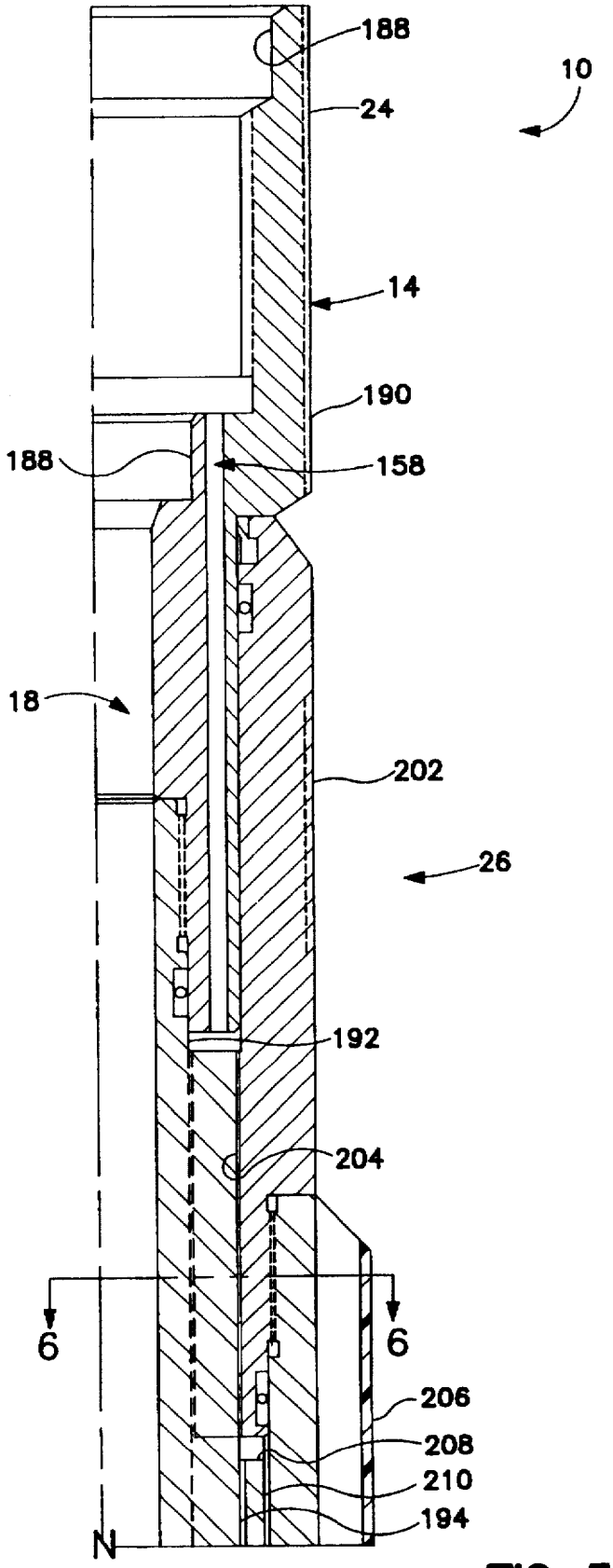
FIGS. 5A–5F are quarter-sectional views of successive axial portions of a fluid sampling section of the formation testing system, the fluid sampling section being shown in a configuration in which inflatable packers disposed thereon are ready to be inflated.
Figure 5B:
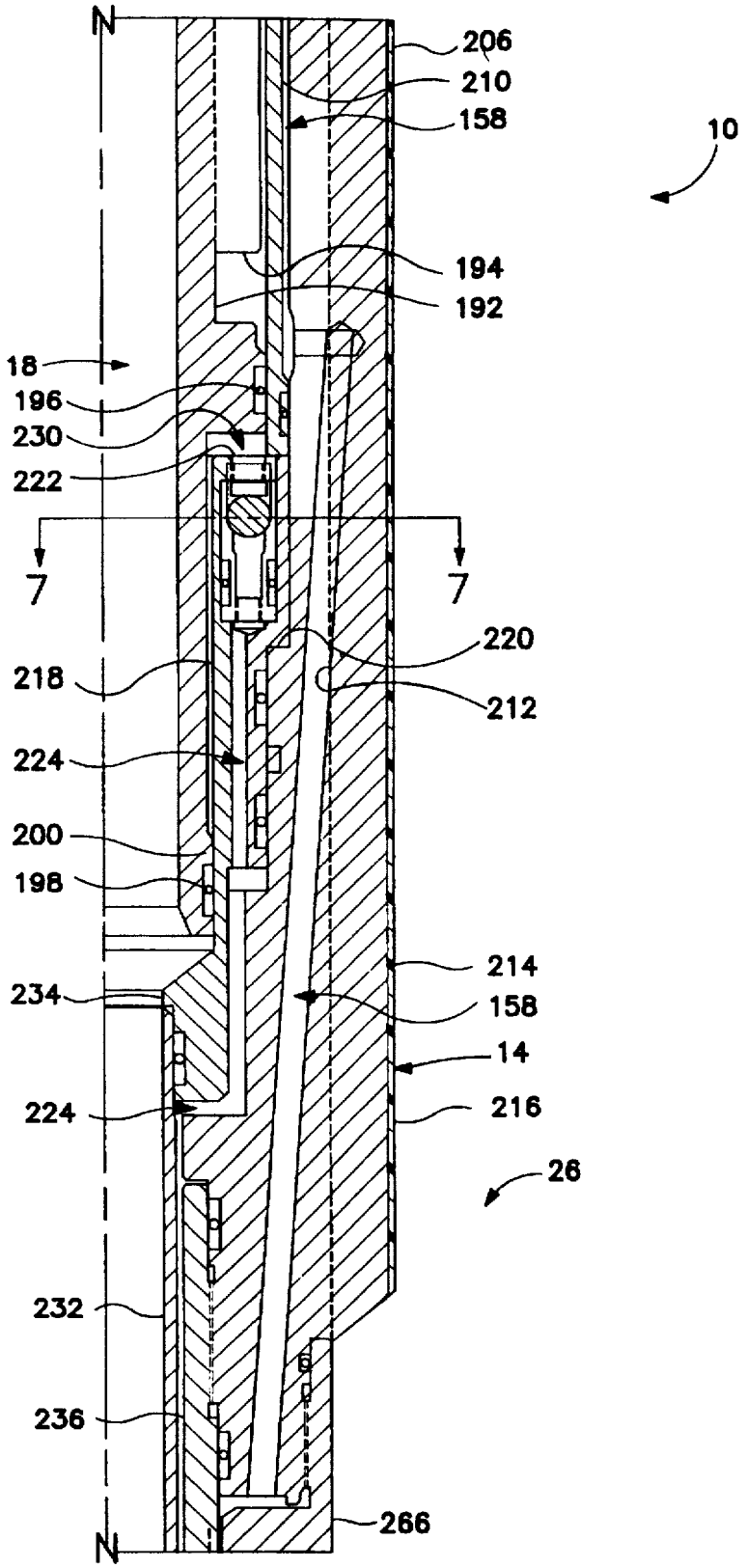
Figure 6:
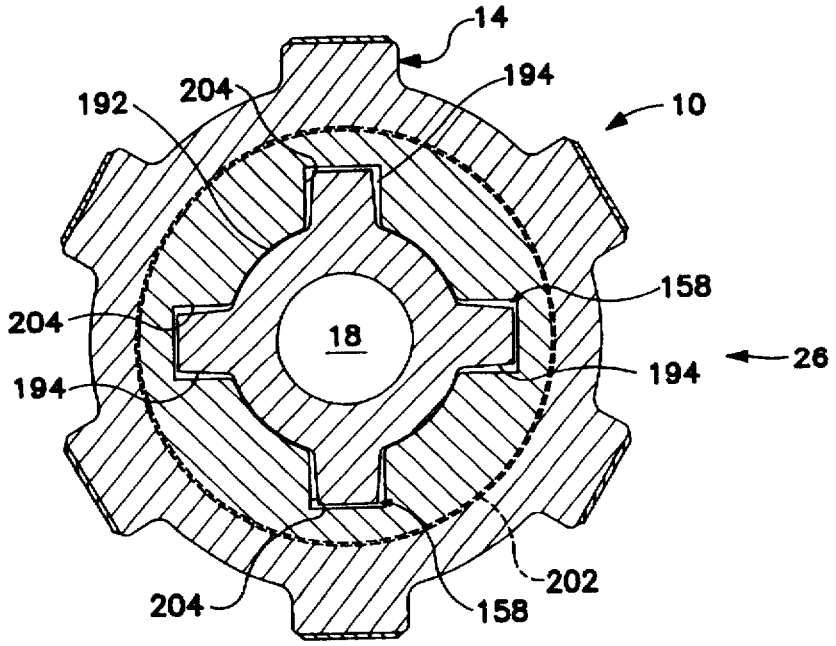
FIG. 6 is a cross-sectional view of a telescoping portion of the fluid sampling section, taken along line 6—6 of FIG. 5A.

The upper connector 190 is threadedly and sealingly attached to an axially extending generally tubular piston 192. Referring additionally to FIG. 6, a cross-section of the fluid sampling section 14 is shown, taken along line 6—6 of FIG. 5A, wherein it may be clearly seen that the piston 192 has a series of circumferentially spaced apart and axially extending splines 194 externally formed thereon. Referring specifically now to FIG. 5B, it may be seen that a circumferential seal 196 is carried externally on the piston 192, and another circumferential seal 198 is carried externally on the piston at a radially reduced portion 200 thereof. Thus, a differential area is formed on the piston 192 radially between the seal 196 and the seal 198.

The piston 192 is axially slidingly received in an axially extending generally tubular upper housing 202. Referring to FIG. 6, it may be seen that the upper housing 202 has a circumferentially spaced apart series of axially extending slots 204 formed internally thereon. The splines 194 are axially slidingly received in the slots 204. However, in the illustrated preferred embodiment of the present invention, the slots 204 are somewhat enlarged relative to the splines 194, so that the inflation flow passage 158 may conveniently extend axially therebetween. Note, also, that sides of the splines 194 are radially inclined somewhat, so that when torque is transmitted through the fluid sampling section 14, the sides of the splines will flatly contact corresponding sides of the slots 204.

The upper housing 202 is axially slidingly and sealingly engaged with the upper connector 190. An axially extending generally tubular upper centralizer housing 206 is threadedly and sealingly attached to the upper housing 202. A radially extending port 208 formed through a lower tubular portion 210 of the upper housing 202 permits fluid communication between the inflation flow passage 158 in the area between the slots 204 and splines 194, and a series of four generally axially extending openings 212 formed in the upper centralizer housing 206.

Figure 7:
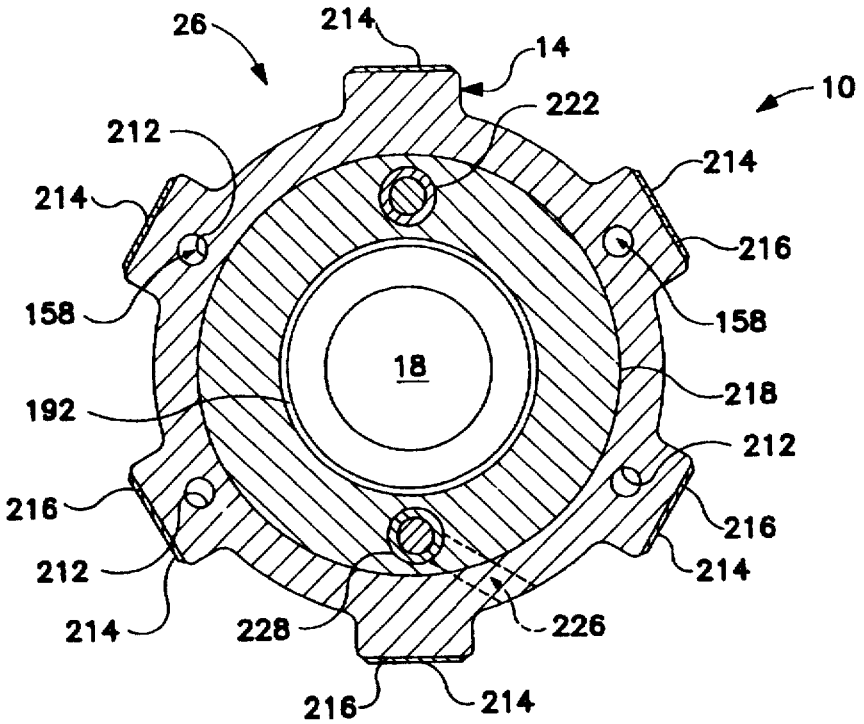
FIG. 7 is a cross-sectional view of a reciprocating pump portion of the fluid sampling section, taken along line 7—7 of FIG. 5B.

Referring additionally now to FIG. 7, a cross-sectional view of the fluid sampling section 14 may be seen, taken along line 7—7 of FIG. 5B. In this view, it may be seen that the openings 212 are circumferentially spaced apart and are radially aligned with radially outwardly and axially extending flutes 214 which are formed externally on the centralizer housing 206. Note that any number of openings 212 and/or flutes 214 may be provided and that it is not necessary for each flute to be associated with a corresponding opening. The flutes 214 enable the remainder of the fluid sampling portion 14 to be radially spaced apart from the sides of the wellbore, and may be supplied with wear-resistant coatings or surfaces 216 to deter wear due to contact between the centralizer housing 206 and the sides of the wellbore.

An axially extending generally tubular valve housing 218 is retained axially between the portion 210 of the upper housing 202 and an internal shoulder 220 formed in the centralizer housing 206. In a manner that will be more fully appreciated upon careful consideration of the further description of the fluid sampling section 14 hereinbelow, the valve housing 218 carries two check valves 222, 228 therein and is cooperatively associated with the piston 192 so that axially reciprocating displacement of the piston relative to the valve housing operates to alternately draw fluid through a sample flow passage 224 and expel the fluid via an exhaust flow passage 226 (see FIG. 9B) to the annulus 26.

Figure 9A:
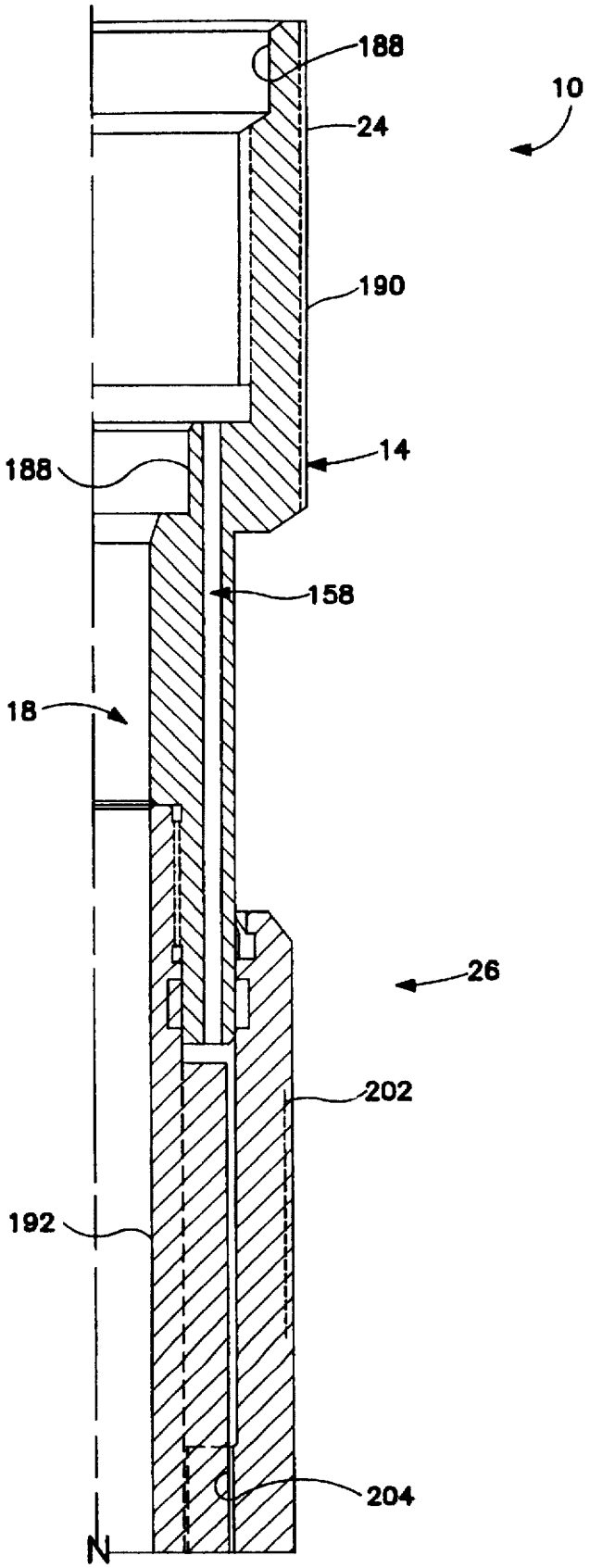
FIGS. 9A–9F are quarter-sectional views of successive axial portions of the fluid sampling section of the formation testing system, the fluid sampling section being shown in a configuration in which fluid is drawn therein.
Figure 9B:
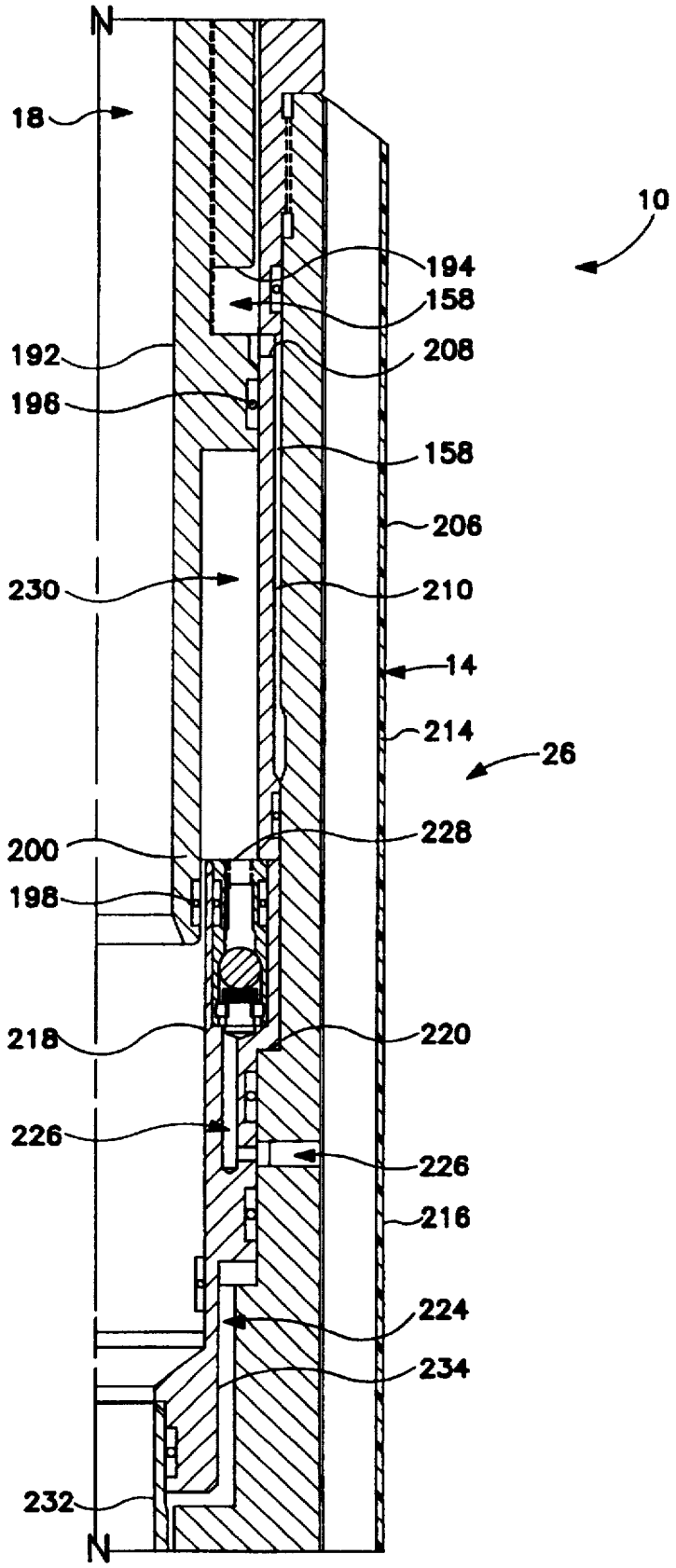
Figure 9C:
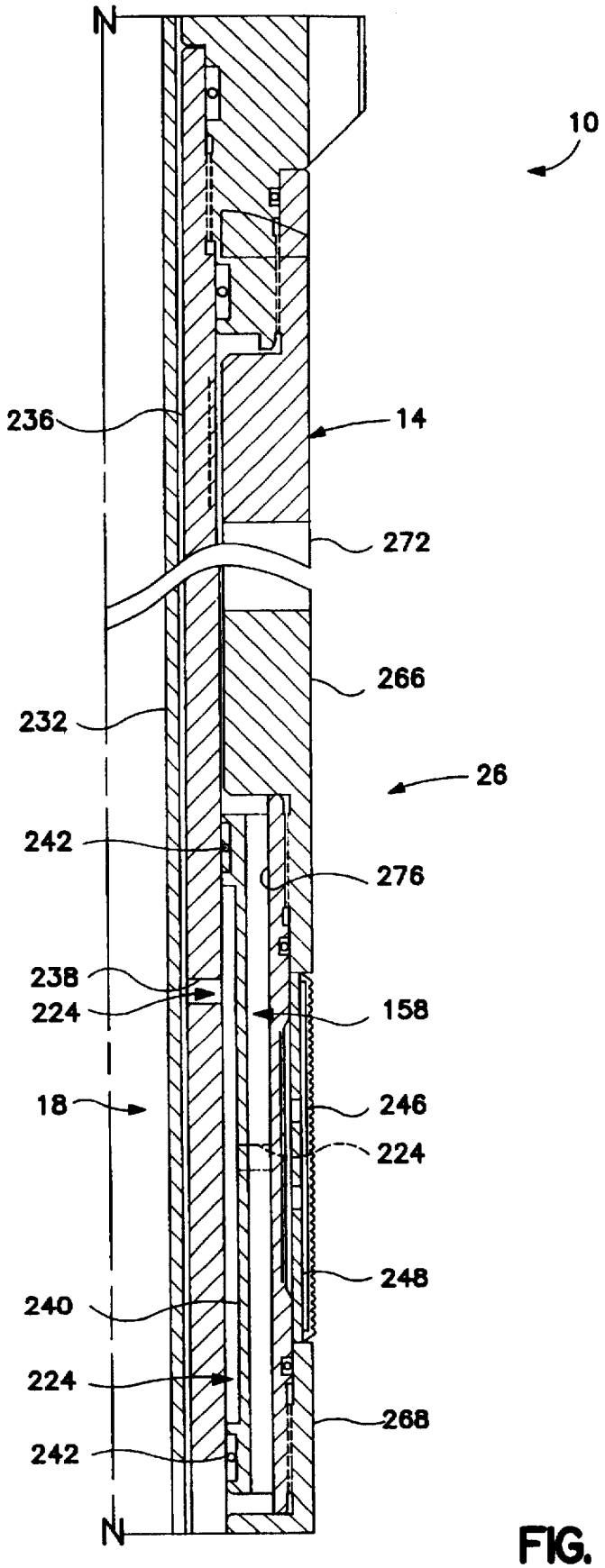
Figure 9D:
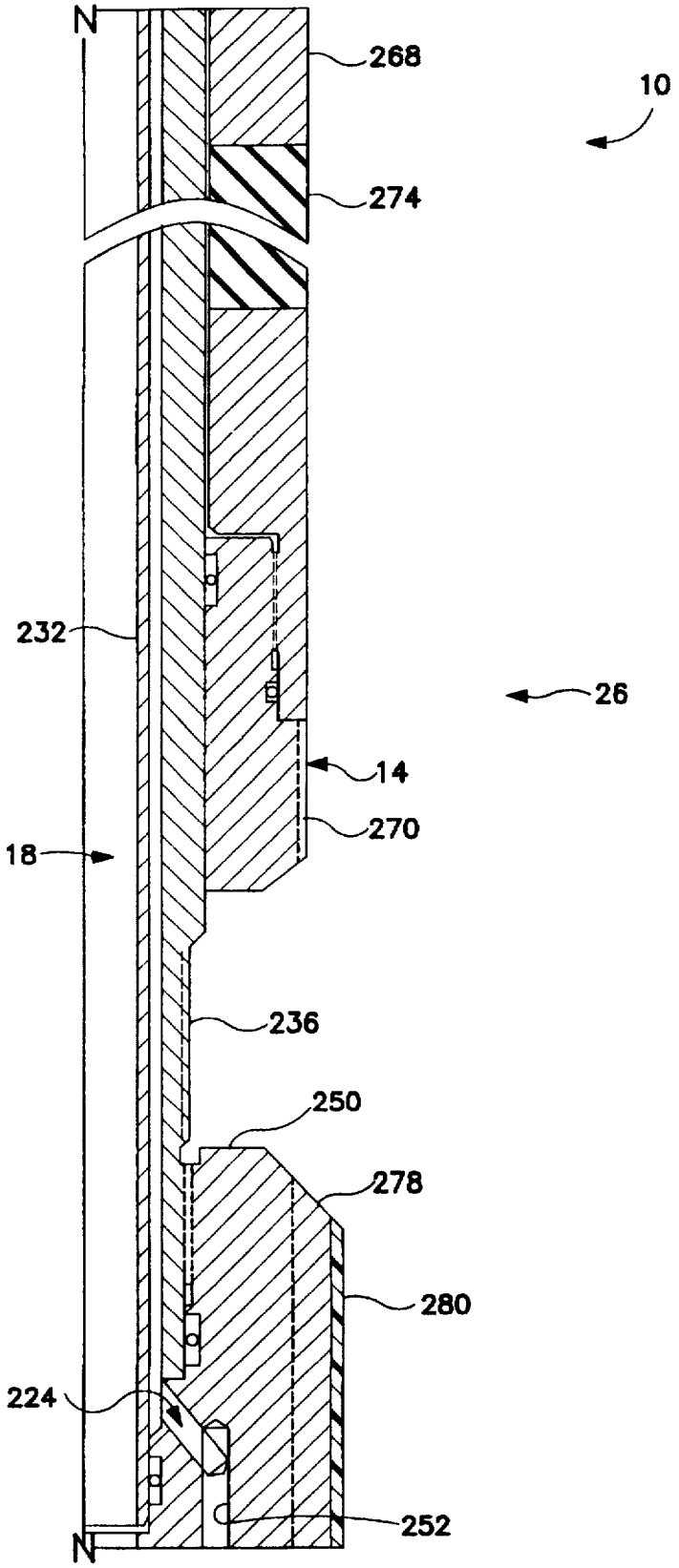
Figure 9E:
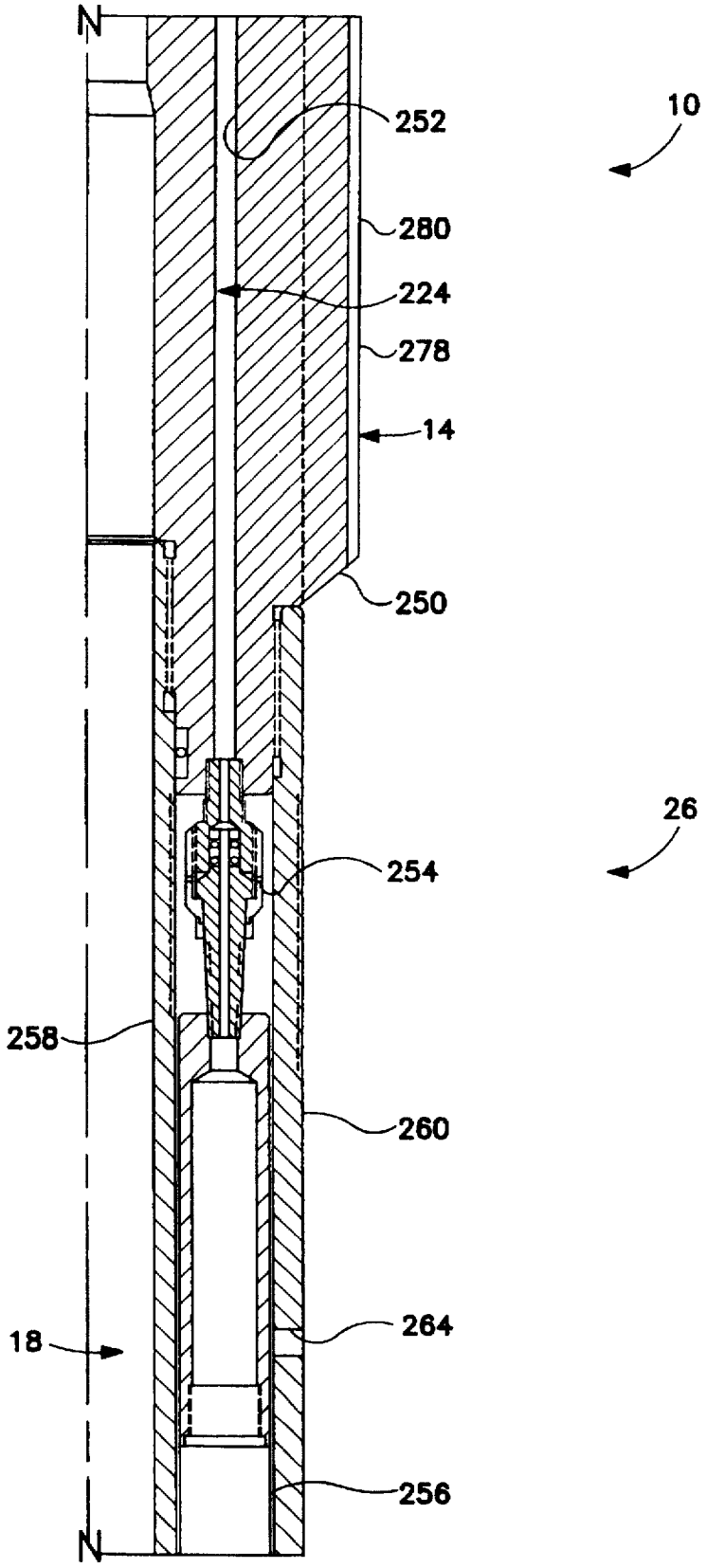
Figure 9F:
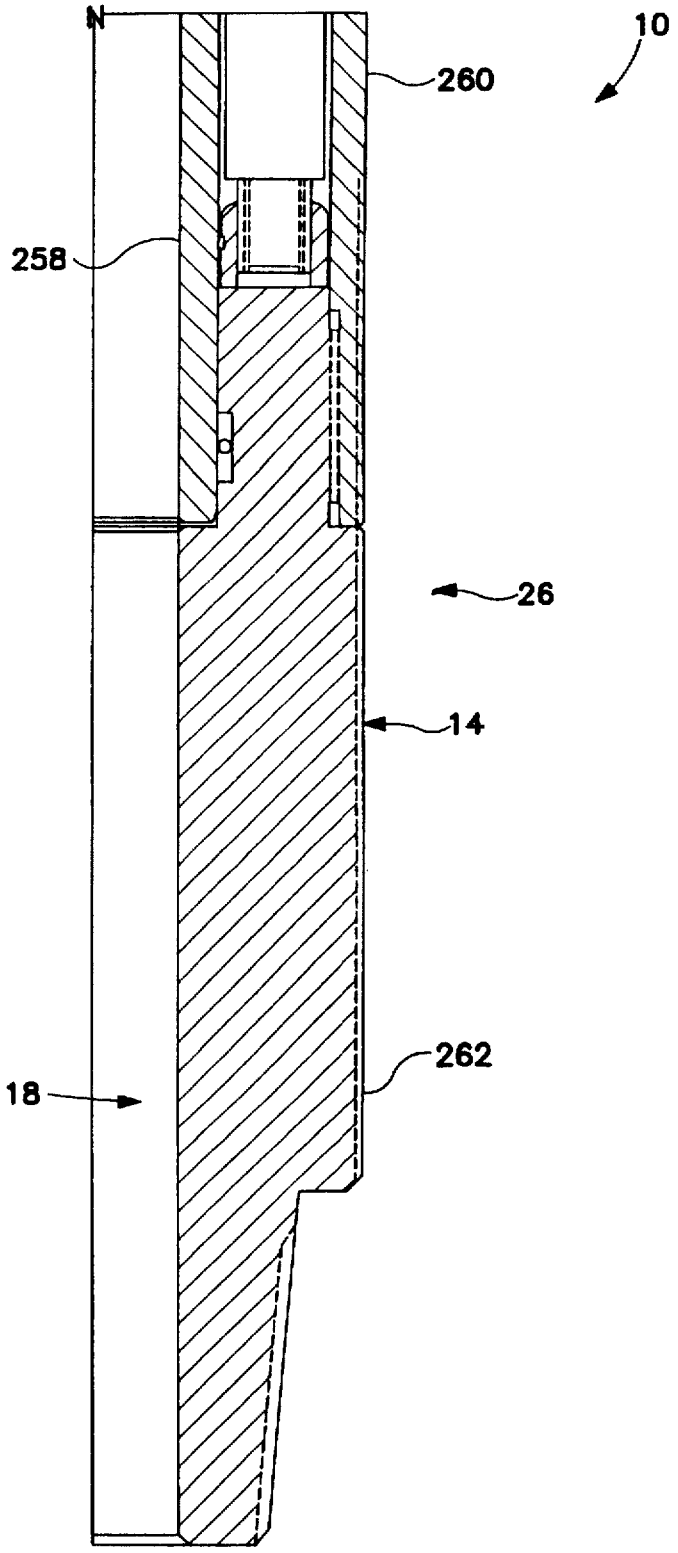

The check valve 222 is visible in FIG. 5B, and the check valve 228 is visible in FIG. 9B, FIG. 9B being rotated somewhat about the vertical axis of the fluid sampling section 14 so that the exhaust flow passage 226 and check valve 228 may be clearly seen. FIG. 7 shows the circumferential orientation of the check valves 222 and 228 with respect to each other and the remainder of the fluid sampling section 14. It may also be seen in FIG. 7 that the exhaust flow passage 226 is actually somewhat circumferentially inclined with respect to the remainder of the fluid sampling section 14, whereas FIG. 9B shows the exhaust flow passage as if it extends orthogonally outward from the valve housing 218 for illustrative clarity.

The seal 198 carried externally on the piston 192 internally sealingly engages the valve housing 218, and the seal 196 internally sealingly engages the portion 210 of the upper housing 202. When the piston 192 is axially upwardly displaced relative to the valve housing 218 by, for example, applying an axially upwardly directed force to the upper connector 190, the differential area between the seals 196, 198 causes a pressure drop across the check valves 222, 228. The check valve 222 is configured within the valve housing 218 so that the pressure drop causes the check valve 222 to open, thereby permitting fluid flow from the sample flow passage 224 axially upwardly through the check valve 222. FIG. 9B shows the piston 192 axially upwardly displaced relative to the valve housing 218, thereby radially expanding a fluid volume 230 therebetween.

If the piston 192 is subsequently axially downwardly displaced relative to the valve housing 218, another oppositely directed pressure drop is created across the check valves 222, 228. The check valve 228 is configured within the valve housing 218 so that the oppositely directed pressure drop causes the check valve 228 to open, thereby permitting fluid flow from the expanded fluid volume 230 to the exhaust flow passage 226.

The check valves 222, 228 are conventional check valves in the illustrated preferred embodiment of the present invention. Preferably, the check valves 222, 228 include biasing members so that they are closed when no pressure drop is present across each of them. Typically, this is accomplished by providing a compression spring which biases a ball toward a seat, the ball being further forced against the seat when a pressure drop is experienced across the check valve in a first direction, and the ball being forced away from the seat against the biasing force of the spring when a pressure drop is experienced across the check valve in a second direction opposite to the first direction. It is to be understood, however, that it is not necessary for such check valves to be utilized in the fluid sampling section 14 according to the principles of the present invention—other means of permitting, preventing, and/or limiting fluid flow from the sample flow passage 224 to the exhaust flow passage 226 may alternatively be provided.

An axially extending generally tubular inner sleeve 232 is axially slidingly and sealingly received within a lower portion 234 of the valve housing 218. The inner sleeve 232 is substantially radially outwardly surrounded by an axially extending generally tubular mandrel 236. The mandrel 236 is threadedly and sealingly attached to the upper centralizer housing 206. The sample flow passage 224 extends radially between the inner sleeve 232 and the mandrel 236.

Figure 5C:
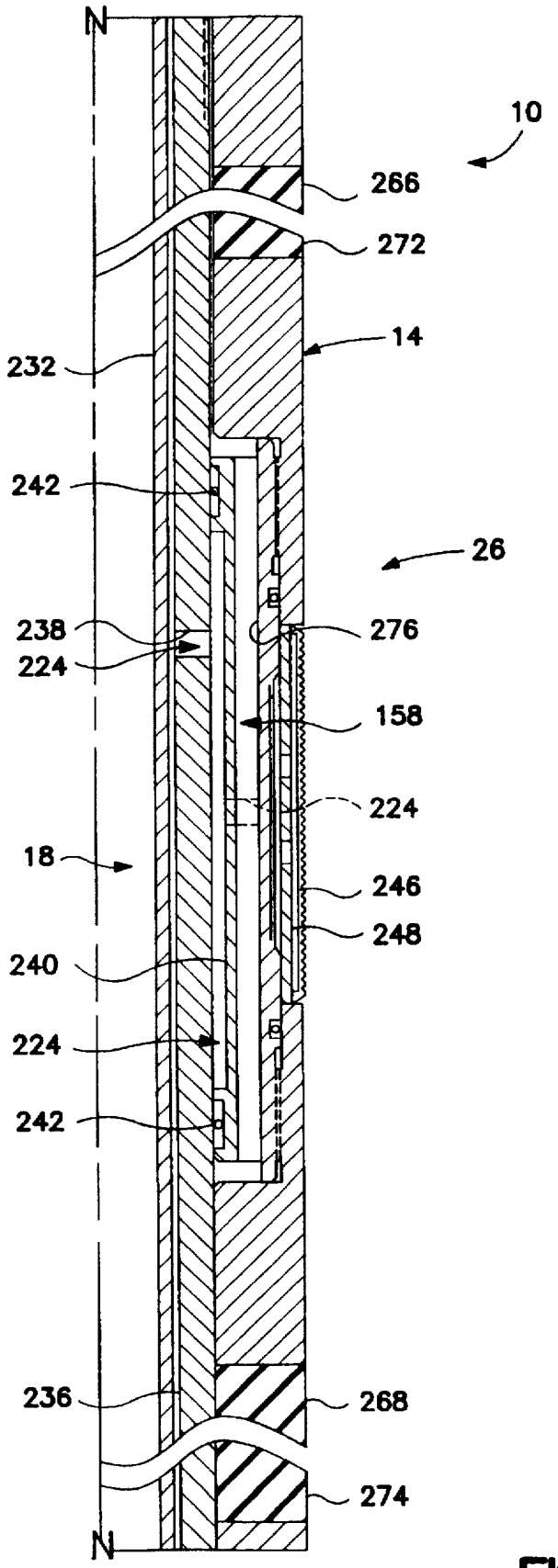
Figure 5D:
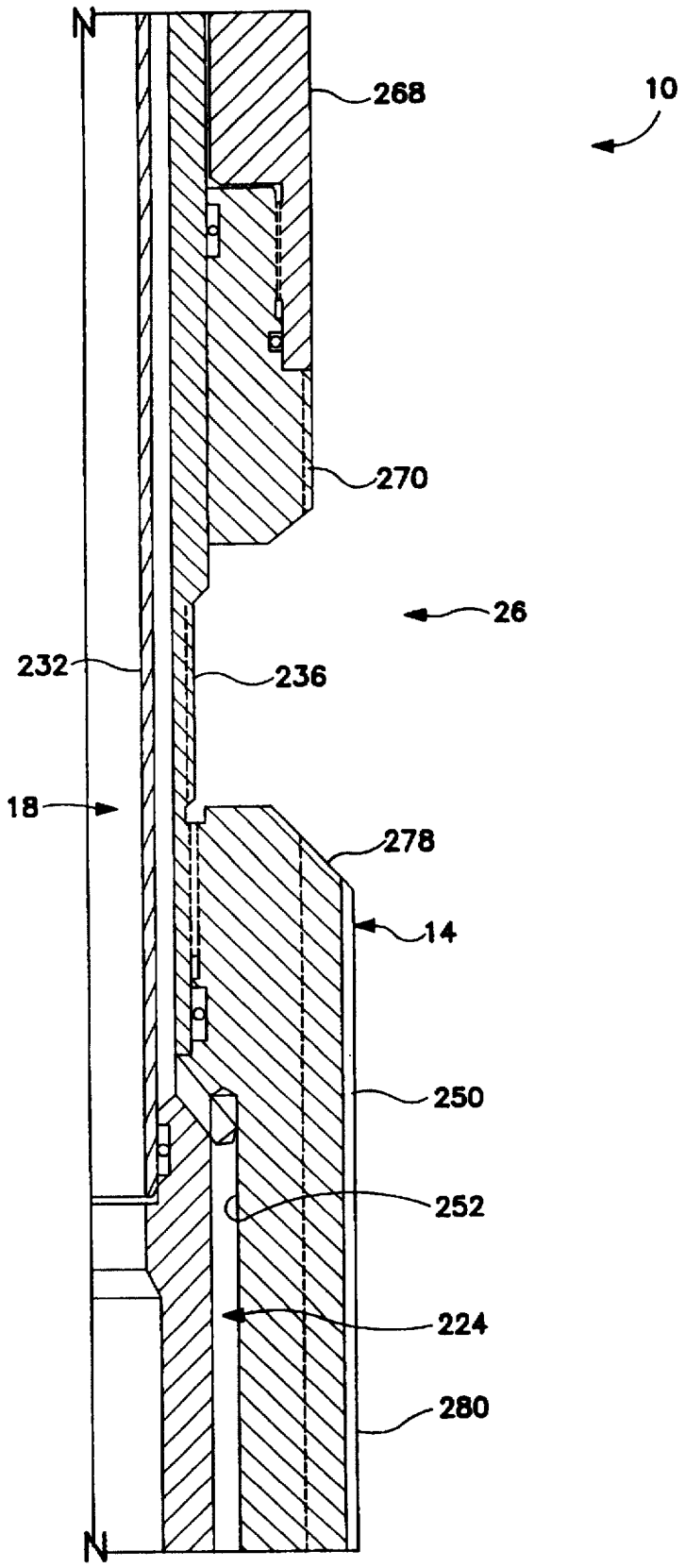

Referring specifically now to FIG. 5C, an opening 238 is formed radially through the mandrel 236, the sample flow passage 224 extending through the opening. An axially extending generally tubular crossover 240 is axially slidingly and sealingly disposed exteriorly on the mandrel 236, such that the opening 238 is axially between circumferential seals 242 carried internally on the crossover. An opening 244 is formed radially through the crossover 240, thereby permitting fluid communication between the opening 238 and a generally tubular screen member 246 exteriorly disposed on the crossover. The screen member 246 includes a perforated inner tube 248.

Thus, it may be seen that the sample fluid passage 224 is in fluid communication with the annulus 26, and that the sample fluid passage permits fluid flow from the annulus 26 to the valve housing 218. When the piston 192 is axially upwardly displaced relative to the valve housing 218, fluid from the annulus 26 is drawn into the fluid sampling section 14 via the sample flow passage 224, filling the axially expanded fluid volume 230. In the illustrated preferred embodiment, approximately one liter of fluid is thereby drawn into the fluid sampling section 14. The screen member 246 prevents debris from entering the fluid sampling section 14 from the annulus 26.

Note that the sample flow passage 224 extends further axially downward from the opening 238 radially between the inner sleeve 232 and the mandrel 236. The mandrel 236 is threadedly and sealingly attached to a lower centralizer housing 250. The inner sleeve 232 is slidingly and sealingly received in the lower centralizer housing 250, and is thus axially retained axially between the lower centralizer housing and the valve housing lower portion 234.

Figure 5E:
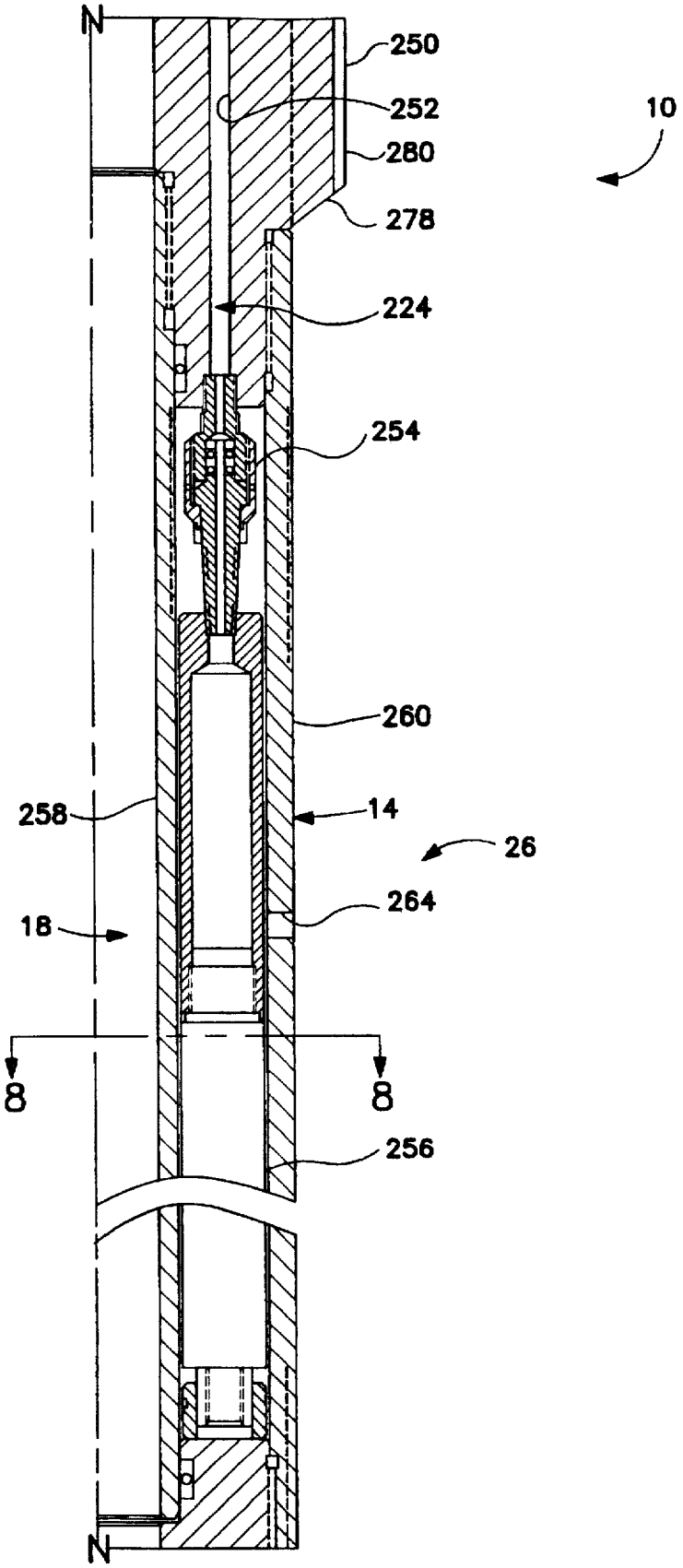
Figure 5F:
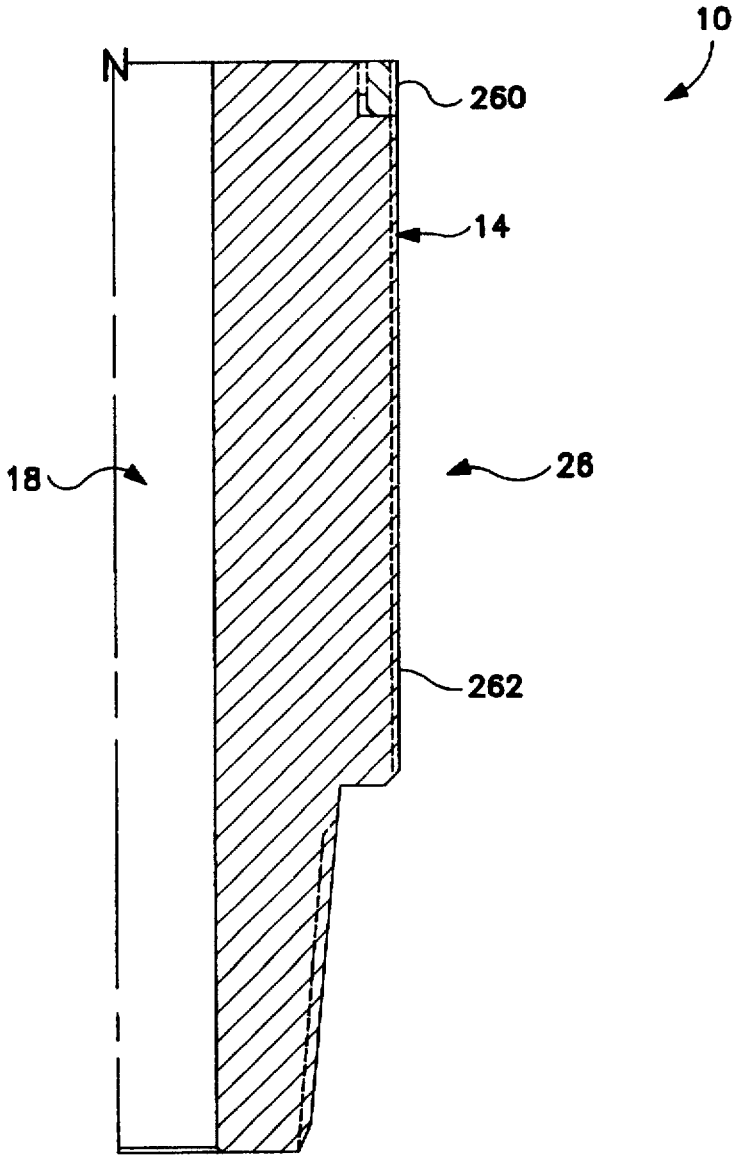

A generally axially extending opening 252 is formed in the lower centralizer housing 250 and is in fluid communication with the sample flow passage 224. Referring specifically now to FIG. 5E, it may be seen that the opening 252, and thus the sample flow passage 224, is in fluid communication with a coupling 254 which, in turn, is in fluid communication with an instrument 256.

The instrument 256 is disposed radially between an axially extending generally tubular inner instrument housing 258 and an axially extending generally tubular outer instrument housing 260. Each of the inner and outer instrument housings 258, 260 are threadedly attached to the lower centralizer housing 250, and the outer centralizer housing 260 is threadedly attached to an axially extending generally tubular lower connector 262. The inner instrument housing 258 is sealingly attached to the lower centralizer housing 250 and to the lower connector 262. The lower connector 262 permits the fluid sampling section 14 to be sealingly and threadedly attached to additional portions of the drill string below the fluid sampling section. An opening 264 is formed radially through the outer instrument housing 260 opposite the instrument 256, thereby providing fluid communication, if desired, between the instrument 256 and the annulus 26, and preventing retention of atmospheric pressure radially between the inner and outer instrument housings 258, 260. Note that the opening 264 could also be ported to the flow passage 18 through the inner instrument housing 258, in which case the outer instrument housing 260 would preferably sealingly engage the lower centralizer housing 250 and the lower connector 262.

Figure 8:
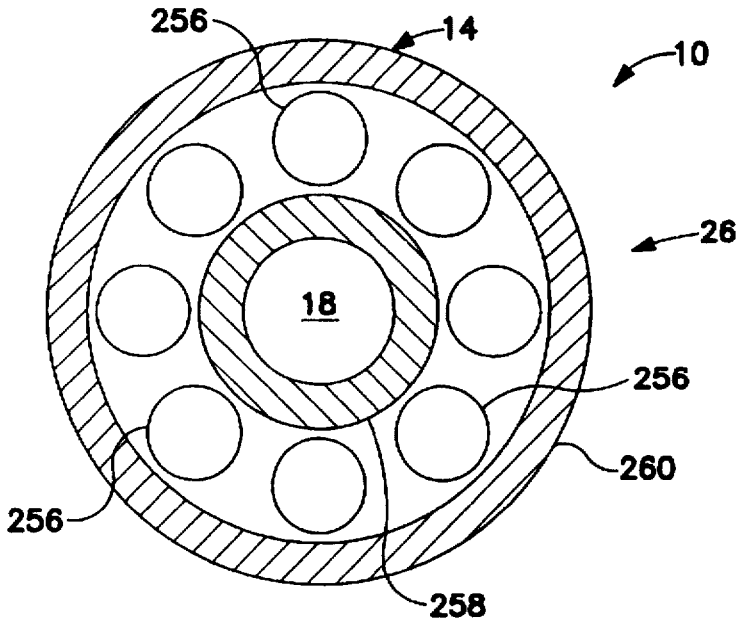
FIG. 8 is a cross-sectional view of an instrument portion of the fluid sampling section, taken along line 8—8 of FIG. 5E.

It may now be fully appreciated that when fluid from the annulus 26 is drawn into the sample flow passage 224 as hereinabove described, the instrument 256 is exposed to that fluid. Referring additionally now to FIG. 8, a cross-sectional view of the fluid sampling section 14 is shown, taken along line 8—8 of FIG. 5E. In FIG. 8 it may be clearly seen that there may be more than one instrument 256 disposed between the inner and outer instrument housings 258, 260, representatively eight of them. The instruments 256 may be any combination of temperature gauges, pressure gauges (including differential pressure gauges), gamma ray detectors, resistivity meters, etc., which may be useful in measuring and recording characteristics of the fluid drawn into the sample flow passage 224, or of the surrounding subterranean formation, etc. If more than one instrument 256 is utilized, more than one opening 252 may be provided in fluid communication with sample flow passage 224. Various ones of the openings 252 may also be ported directly to the annulus 26, to the flow passage 18, or to any other desired location.

It is important to understand that the fluid drawn into the sample flow passage 224 by the fluid sampling section 14, although drawn from the annulus 26, is preferably indicative of characteristics of a particular formation intersected by the wellbore. This result is accomplished by inflating a pair of packers 266, 268 axially straddling the crossover 240, so that the packers sealingly engage the sides of the wellbore. In this manner, the fluid drawn from the annulus 26 into the sample flow passage 224 is in fluid communication with the formation, but is isolated from the remainder of the wellbore.

Inflatable packers are well known in the art. They are typically utilized in uncased wellbores where it is desired to radially outwardly sealingly engage the sides of the wellbores with tubular strings disposed in the wellbores. However, the applicants have uniquely configured the packers 266, 268 so that they are closely axially spaced apart and remain so when inflated, thereby enabling relatively short axial portions of a formation intersected by the wellbore (or a formation which is itself relatively thin) to be sampled by the fluid sampling section 14.

The upper packer 266 is threadedly and sealingly attached to the upper centralizer housing 206 and is threadedly and sealingly attached to the crossover 240. The lower packer 268 is threadedly and sealingly attached to the crossover 240 and is threadedly and sealingly attached to an axially extending generally tubular plug 270. The plug 270 is sealingly and axially slidingly disposed externally on the mandrel 236. Thus, it may be clearly seen that the packers 266, 268 are axially secured to the remainder of the fluid sampling section 14 only at the upper centralizer housing 206. So configured, the packers 266, 268 are maintained in relatively close axial proximity to each other when they are inflated.

The packers 266, 268 are inflated by applying fluid pressure to the inflation flow passage 158, which produces a differential fluid pressure from the inflation flow passage to the annulus 26. Note that such differential fluid pressure has been previously described hereinabove in relation to the description of the valve actuating section 12, and may be approximately 1,000 psi. When the packers 266, 268 are inflated, elastomeric seal elements 272, 274, respectively, are expanded radially outward into sealing contact with the sides of the wellbore, preferably axially straddling a formation or portion of a formation where it is desired to sample properties of fluid therefrom. Note that, although FIGS. 9A–9F do not show the packers 266, 268 inflated, they may be so inflated with the fluid sampling section 14 in its representatively illustrated configuration.

Referring specifically now to FIG. 5C, it may be seen that the inflation flow passage 158 extends axially through the crossover 240 via an opening 276 formed axially therethrough. The packers 266, 268 are somewhat radially spaced apart from the mandrel 236 so that the inflation flow passage 158 also extends radially between the packers and the mandrel 236. In FIG. 5B it may be seen that the inflation flow passage 158 radially between the packers 266, 268 is in fluid communication with the openings 212 formed in the upper centralizer housing 206.

When the packers 266, 268 are not inflated they are protected from potentially abrasive contact with the sides of the wellbore by the flutes 214 on the upper centralizing housing 206 and by similar flutes 278 formed externally on the lower centralizer housing 250. Note that each of the flutes 278 may also be provided with a wear resistant coating 280 similar to the coating 216. Thus, the elastomeric seal elements 272, 274 are suspended radially away from the sides of the wellbore when the packers 266, 268 are not inflated.

In a preferred manner of using the formation testing system 10, the valve actuating section 12 and the fluid sampling section 14 are interconnected in a drill string (the valve actuating section being in its open configuration) and are disposed within a subterranean wellbore. Normal drilling operations are commenced utilizing the drill string, wherein fluid, such as drilling mud, is circulated through the drill string and returned to the earth's surface via the annulus 26 formed radially between the drill string and the sides of the wellbore. Periodically, the circulation of fluids is ceased, for example, to add drill pipe to the drill string at the earth's surface.

As more fully described hereinabove, such normal drilling operations, wherein a differential fluid pressure of approximately 500–1,000 psi is produced from the interior of the drill string to the annulus 26 due to circulation of fluids therethrough, accomplishes no substantial change in the configurations of the valve actuating section 12 or fluid sampling section 14. When, however, it is desired to perform a test at a particular formation intersected by the wellbore, the differential fluid pressure is increased from approximately 0 psi to approximately 300–500, reduced to approximately 0 psi, increased to approximately 500–1,000 psi, and then reduced again to approximately 0 psi. In this way, the valve actuating section 12 is changed to its closed configuration and the flow passage 18 above the ball 144 is placed in fluid communication with the inflation flow passage 158.

Fluid pressure may then be applied to the interior of the drill string at the earth's surface, which fluid pressure is thereby transmitted to the flow passage 18 above the ball 144 and to the inflation flow passage 158 in order to inflate the seal elements 272, 274. When the seal elements 272, 274 have been sufficiently inflated such that they sealingly engage the sides of the wellbore axially straddling a desired formation or portion of a formation, an axially upwardly directed force is applied to the drill string at the earth's surface to axially upwardly displace the piston 192 relative to the valve housing 218 and, thereby, draw fluid into the sample flow passage 224 from the annulus 26 axially between the inflated seal elements. Note that when the seal elements 272, 274 are inflated the piston 192 may already be axially upwardly displaced relative to the valve housing 218 as shown in FIG. 9B, therefore, it is preferred that the piston be axially downwardly displaced initially to ensure that a sufficient volume of fluid is drawn into the sample flow passage when the piston 192 is subsequently axially upwardly displaced relative to the valve housing.

In a common type of formation test, the fluid pressure in the wellbore adjacent to the desired formation or formation portion is lowered and a recording is made of the fluid pressure and rate of change of fluid pressure, giving those skilled in the art an indication of characteristics of the formation, such as the formation's permeability, etc. Such formation tests and others may be accomplished by the hereinabove described drawing of fluid from the annulus 26 into the sample flow passage 224, while corresponding fluid pressures, temperatures, etc. are recorded by the instruments 256 in the fluid sampling section 14. Note that the instruments 256 may record continuously from the time they are inserted into the wellbore until they are withdrawn therefrom, or they may be periodically activated and/or deactivated while they are in the wellbore.

Additional fluid may be drawn from the annulus 26 into the sample flow passage 224 by axially downwardly displacing the piston 192 relative to the valve housing 218, thereby displacing the previously sampled fluid from the fluid volume 230 to the annulus 26 above the upper seal element 272 via the exhaust flow passage 226, and again axially upwardly displacing the piston relative to the valve housing. The piston 192 may, thus, be repeatedly axially reciprocated within the fluid sampling section 14 to, for example, draw a desired volume of fluid from the annulus 26 between the seal elements 272, 274, produce a desired pressure drop in the annulus 26 between the seal elements 272, 274, etc.

When the testing operation is concluded, the differential fluid pressure is released from the inflation flow passage 158 to permit the seal elements 272, 274 to deflate radially inwardly. Concurrently, the valve actuating section 12 is changed to its open configuration and normal drilling operations may be resumed. The above sequence of performing drilling operations, testing a formation intersected by the wellbore, and then resuming drilling operations may be repeated as desired, without the necessity of withdrawing the drill string from the wellbore to separately run testing tools therein. Of course, if the instruments 256 are battery-powered or are otherwise subject to time limitations, it may be necessary to periodically retrieve the instruments.

It will be readily apparent to one of ordinary skill in the art that, if the fluid sampling section 14 is modified so that the check valves 222, 228 are eliminated and the exhaust flow passage 226 is not provided, fluid may still be drawn into the sample flow passage by axially upwardly displacing the piston 192 relative to the valve housing 218 after the seal elements 272, 274 are inflated. The valves 222, 228 may also be reversed from their representatively illustrated orientations so that reciprocation of the piston 192 relative to the valve housing 218 operates to force fluid from the exhaust flow passage 226 to the sample flow passage 224 in order to, for example, pump fluid into a formation to acidize or fracture the formation, etc. Thus, such modifications to the preferred embodiment of the formation testing system 10 described hereinabove may be made without departing from the principles of the present invention.

It will be readily apparent to one of ordinary skill in the art that the formation testing system 10 is of particular benefit in generally horizontally oriented portions of subterranean wellbores. However, it is to be understood that the formation testing system 10 may be utilized to great advantage in vertical and inclined portions of wellbores as well. The formation testing system 10 may also be utilized in cased wellbores, and may also be utilized in operations wherein, strictly speaking, drilling of a wellbore is not also performed.

It will also be readily apparent to one of ordinary skill in the art that the various load-carrying elements of the formation testing system 10 as representatively illustrated are joined utilizing straight threads which may not be suitable for applications wherein high torque loads are to be encountered, but it is to be understood that other threads may be utilized, and other similar modifications may be made to the elements of the formation testing system 10 without departing from the principles of the present invention.

The foregoing detailed description is to be clearly understood as being given by way of illustration and example only, the spirit and scope of the present invention being limited solely by the appended claims.

What is claimed is:

1. Apparatus operatively positionable in a subterranean well, the apparatus comprising:

a first flow passage formed interiorly through the apparatus;

a first piston, the first piston being configured to displace in response to fluid pressure in the first flow passage greater than fluid pressure external to the apparatus;

a second piston, the second piston being configured to displace in response to fluid pressure in the first flow passage greater than fluid pressure external to the apparatus, the second piston displacement being oppositely directed relative to the first piston displacement; and a valve, the valve being configured to selectively permit and prevent fluid flow through the first flow passage in response to displacement of a selected one of the first and second pistons.

2. The apparatus according to claim 1, wherein the valve prevents fluid flow through the first flow passage in response to displacement of the first piston, and wherein the valve permits fluid flow through the first flow passage in response to displacement of the second piston.

3. The apparatus according to claim 1, wherein the first flow passage is divided into first and second portions when the valve prevents fluid flow therethrough, and further comprising a second flow passage, the second flow passage being in fluid communication with the first portion of the first flow passage when the valve prevents fluid flow therethrough, and the second flow passage being in fluid isolation from the first flow passage when the valve permits fluid flow therethrough.

4. The apparatus according to claim 3, wherein the second portion of the first flow passage is capable of being in fluid communication with an annulus formed radially between the apparatus and side walls of the subterranean well when the valve prevents fluid flow through the first flow passage, and wherein the second flow passage is capable of being in fluid communication with the annulus when the valve permits fluid flow through the first flow passage.

5. Apparatus operatively positionable in a subterranean wellbore, the apparatus comprising:

a first axially extending generally tubular member;

a first packer having opposite ends and a radially outwardly extendable first seal member disposed between the opposite ends, the first packer being exteriorly disposed on the first tubular member, one of the first packer opposite ends being attached to the first tubular member, and the other of the first packer opposite ends being axially slidingly disposed on the first tubular member;

a second axially extending generally tubular member having opposite ends and an opening formed through a sidewall portion of the second tubular member between the opposite ends, the second tubular member being exteriorly slidingly disposed on the first tubular member, and one of the second tubular member opposite ends being attached to the other of the first packer opposite ends; and a second packer having opposite ends and a radially outwardly extendable second seal member disposed between the opposite ends, the second packer being exteriorly slidingly disposed on the first tubular member, one of the second packer opposite ends being attached to the other of the second tubular member opposite ends, and the other of the second packer opposite ends being axially slidingly disposed on the first tubular member, whereby when the first and second seal members are radially outwardly extended, the second packer, second tubular member, and the other of the first packer opposite ends are capable of slidingly displacing on the first tubular member.

6. The apparatus according to claim 5, wherein the first tubular member has a port formed through a sidewall portion thereof, and wherein the opening is in fluid communication with the port when the first and second seal members are radially outwardly extended.

7. The apparatus according to claim 5, further comprising a pair of circumferential seals axially straddling the opening, wherein the second tubular member further has a flow passage formed therethrough from one of the opposite ends to the other of the opposite ends, and wherein the seals prevent fluid communication between the opening and the flow passage.

8. The apparatus according to claim 7, wherein each of the first and second packers is an inflatable packer, and wherein the flow passage is in fluid communication with an interior portion of each of the first and second seal members.

9. Apparatus operatively disposable within a subterratean well, the well having a wellbore intersecting a formation, the apparatus comprising:

a generally tubular crossover having interior and exterior surfaces, first and second opposite ends, a first opening providing fluid communication from the interior to the exterior surface, and a second opening providing fluid communication from the first to the second opposite end;

a first inflatable packer attached to the crossover first opposite end, the first inflatable packer being in fluid communication with the second opening, and the first inflatable packer being capable of being inflated in response to fluid pressure in the second opening to sealingly engage the wellbore; and a second inflatable packer attached to the crossover second opposite end, the second inflatable packer being in fluid communication with the second opening, and the second inflatable packer being capable of being inflated in response to fluid pressure in the second opening to sealingly engage the wellbore, whereby the first and second inflatable packers are capable of sealingly engaging the wellbore adjacent the formation, and the first opening thereby being in fluid communication with the formation and in fluid isolation from the remainder of the wellbore.

10. The apparatus according to claim 9, wherein each of the first and second inflatable packers and the crossover is at least partially slidably disposed on a generally tubular mandrel, a first annular space being thereby formed radially between the first inflatable packer and the mandrel, a second annular space being thereby formed radially between the second inflatable packer and the mandrel, and the second opening being in fluid communication with each of the first and second annular spaces.

11. The apparatus according to claim 10, wherein the crossover interior surface is in sealing engagement with the mandrel, the first opening being thereby isolated from fluid communication with the first and second annular spaces.

12. The apparatus according to claim 10, wherein the mandrel has a third opening formed through a sidewall portion thereof, and further comprising first and second seals, the first and second seals axially straddling the third opening and sealingly engaging the mandrel and the crossover, and the first and second seals preventing fluid communication between the third opening and each of the first and second annular spaces.

13. Apparatus operatively positionable in a subterranean well, the apparatus comprising:

a first generally tubular member having first and second interior portions, the second interior portion being radially reduced relative to the first interior portion;

a second generally tubular member having first and second exterior portions, the second exterior portion being radially reduced relative to the first exterior portion, and the second tubular member being telescopingly received in the first tubular member, such that a variable annular volume is formed radially between the second exterior portion and the first interior portion;

a first circumferential seal, the first seal sealingly engaging each of the first interior surface and the first exterior surface;

a second circumferential seal, the second seal sealingly engaging each of the second interior surface and the second exterior surface; and a first flow passage, the first flow passage being in fluid communication with the annular volume, and the first flow passage being capable of fluid communication with an annulus formed radially between the apparatus and sides of the subterranean well, whereby when the first and second tubular members are displaced relative to each other to increase the annular volume, the first flow passage permits fluid flow from the annulus to the annular volume.

14. The apparatus according to claim 13, further comprising a first valve, the first valve permitting fluid flow from the annulus to the annular volume through the first flow passage, and the first valve preventing fluid flow from the annular volume to the annulus through the first flow passage.

15. The apparatus according to claim 13, further comprising a second flow passage, the second flow passage being in fluid communication with the annular volume, and the second flow passage being capable of fluid communication with the annulus, whereby when the first and second tubular members are displaced relative to each other to decrease the annular volume, the second flow passage permits fluid flow from the annular volume to the annulus.

16. The apparatus according to claim 15, further comprising:

a first valve, the first valve permitting fluid flow from the annulus to the annular volume through the first flow passage, and the first valve preventing fluid flow from the annular volume to the annulus through the first flow passage; and a second valve, the second valve permitting fluid flow from the annular volume to the annulus through the second flow passage, and the second valve preventing fluid flow from the annulus to the annular volume through the second flow passage.

17. Apparatus operatively positionable within a subterranean wellbore, the wellbore intersecting a plurality of formations, the apparatus comprising:

first and second packers, the first and second packers being capable of sealingly engaging sides of the wellbore adjacent a selected one of the formations;

a sample flow passage disposed axially between the first and second packers, the sample flow passage being capable of fluid communication with the selected one of the formations when the first and second packers sealingly engage sides of the wellbore adjacent the selected one of the formations;

a pump, the pump being capable of drawing fluid from the selected one of the formations through the sample flow passage; and a valve, the valve being in selectable fluid communication with the first and second packers, the valve permitting sealing engagement of the first and second packers with the sides of the wellbore adjacent the selected one of the formations, the valve permitting disengagement of the first and second packers from the sides of the wellbore adjacent the selected one of the formations, and the valve permitting sealing engagement of the first and second packers with the sides of the wellbore adjacent another one of the formations subsequent to disengagement of the first and second packers from the sides of the wellbore adjacent the selected one of the formations.

18. The apparatus according to claim 17, wherein the apparatus is operatively connectable to a tubular string extending to the earth's surface, and wherein the pump is activatable to draw fluid through the sample flow passage by lifting the tubular string at the earth's surface.

19. The apparatus according to claim 17, wherein the apparatus is operatively connectable to a tubular string extending to the earth's surface, and wherein the valve is activatable to permit selected sealing engagement and disengagement of the first and second packers by selectively applying and releasing fluid pressure to and from the tubular string at the earth's surface.

20. The apparatus according to claim 17, further comprising an instrument, the instrument being in fluid communication with the sample flow passage, such that the instrument is capable of measuring a characteristic of fluid in the sample flow passage.

21. Apparatus operatively positionable in a subterranean well, the apparatus comprising:

an axially extending actuator member;

a first piston reciprocably disposed relative to the actuator member, the first piston being capable of displacing relative to the actuator member in response to a first change of fluid pressure acting thereon;

a first ratchet attached to one of the first piston and the actuator member, the first ratchet having a first path formed thereon;

a first pin attached to the other of the first piston and the actuator member, the first pin being operatively disposed in the first path, the first path being configured to permit the first piston to displace the actuator member in a first axial direction in response to the first change of fluid pressure;

a second piston reciprocably disposed relative to the actuator member, the second piston being capable of displacing relative to the actuator member in response to a second change of fluid pressure acting thereon;

a second ratchet attached to one of the actuator member and the second piston, the second ratchet having a second path formed thereon; and a second pin attached to the other of the actuator member and the second piston, the second pin being operatively disposed in the second path, the second path being configured to permit the second piston to displace the actuator member in a second axial direction opposite to the first axial direction in response to the second change of fluid pressure.

22. The apparatus according to claim 21, further comprising a valve operatively connected to the actuator member, the actuator member being capable of closing the valve when the first piston displaces the actuator member in the first axial direction, and the actuator member being capable of opening the valve when the second piston displaces the actuator member in the second axial direction.

23. The apparatus according to claim 21, wherein the actuator member and the first and second pistons are each generally tubular shaped, and wherein the first and second pistons are exteriorly slidably disposed on the actuator member.

24. The apparatus according to claim 23, wherein the first and second pistons are capable of being urged in axially axially opposite directions in response to fluid pressure changes within the actuator member.

25. Apparatus operatively positionable in a subterranean wellbore, the apparatus comprising:

a generally tubular outer housing having an exterior side surface;

a generally tubular inner mandrel having an interior side surface, the inner mandrel being received in the outer housing; and first and second generally tubular pistons, each of the first and second pistons being axially slidably disposed radially between the outer housing and the inner mandrel, the first piston being capable of displacing in a first axial direction relative to the inner mandrel in response to a positive differential pressure from the interior side surface of the inner mandrel to the exterior side surface of the outer housing, and the second piston being capable of displacing in a second axial direction relative to the inner mandrel opposite to the first axial direction in response to the differential fluid pressure.

26. The apparatus according to claim 25, further comprising a pin and a ratchet interconnected between the first piston and the inner mandrel, the pin being capable of operatively engaging the ratchet and causing the inner mandrel to axially displace with the first piston in response to the differential fluid pressure.

27. The apparatus according to claim 26, wherein the pin is capable of operatively engaging the ratchet and causing the inner mandrel to axially displace with the first piston only in response to a change in the differential fluid pressure.

28. The apparatus according to claim 26, further comprising a valve operatively connected to the inner mandrel, the inner mandrel being capable of selectively opening and closing the valve by axial displacement of the inner mandrel.

29. Apparatus operatively positionable in a subterranean well, the apparatus comprising:

a ratchet having a path formed thereon, the path having first and second interconnected portions;

a pin operatively disposed in the path, the pin being displaceable in the path relative to the ratchet;

a first force member, the first force member being capable of displacing the pin in the path in a first direction relative to the ratchet; and a resistance member attached to the first force member, the resistance member being capable of selectively inhibiting displacement of the pin in the path in the first direction relative to the ratchet to thereby permit the pin to displace from the first portion to the second portion.

30. The apparatus according to claim 29, further comprising a second force member, the second force member exerting a biasing force against the first force member in a second direction opposite to the first direction, and the second force member being capable of displacing the pin from the first portion to the second portion.

31. The apparatus according to claim 29, wherein the first force member is capable of displacing the the pin in the path in the first direction relative to the ratchet in response to a differential fluid pressure applied between an interior and an exterior portion of the apparatus.

32. The apparatus according to claim 31, wherein the resistance member is capable of stalling displacement of the pin in the path relative to the ratchet at an intersection of the first and second portions when the differential fluid pressure reaches a predetermined level.

33. Apparatus operatively positionable in a subterranean well, the apparatus comprising:

first and second inflatable packers, the first and second inflatable packers being attached to each other, and each of the first and second inflatable packers being radially outwardly extendable from a deflated configuration to an inflated configuration; and first and second substantially rigid centralizers axially straddling the first and second inflatable packers, each of the first and second centralizers having an outer side surface which is radially outwardly disposed relative to the first and second inflatable packers in the deflated configuration, and each of the first and second centralizer outer side surfaces being radially inwardly disposed relative to the first and second inflatable packers in the inflated configuration.

34. The apparatus according to claim 33, further comprising a generally tubular mandrel, wherein the first and second inflatable packers are disposed exteriorly about the mandrel, wherein one of the first and second inflatable packers is attached to the mandrel, and wherein each of the first and second centralizers is exteriorly attached to the mandrel.

35. The apparatus according to claim 34, wherein the other of the first and second inflatable packers is slidably disposed on the mandrel.

36. Apparatus operatively positionable in a subterranean well, the apparatus comprising:

first and second inflatable packers the first and second inflatable packers being attached to each other, and each of the first and second inflatable packers being radially outwardly extendable from a deflated configuration to an inflated configuration;

first and second centralizers axially straddling the first and second inflatable packers, each of the first and second centralizers having an outer side surface which is radially outwardly disposed relative to the first and second inflatable packers in the deflated configuration, and each of the first and second centralizer outer side surfaces being radially inwardly disposed relative to the first and second inflatable packers in the inflated configuration;

a generally tubular mandrel, the first and second inflatable packers being disposed exteriorly about the mandrel, one of the first and second inflatable packers being attached to the mandrel, and each of the first and second centralizers being exteriorly attached to the mandrel; and a generally tubular ported member attached to each of the first and second inflatable packers, the ported member being exteriorly slidably disposed on the mandrel, and the ported member permitting fluid communication from the mandrel to an exterior side surface of the ported member.

37. Apparatus operatively positionable within a wellbore of a subterranean well, an annulus being formed between the apparatus and the wellbore when the apparatus is positioned in the well, the apparatus comprising:

a flow passage formed generally axially through the apparatus;

a first piston displaceable in a first direction in response to a positive fluid pressure differential from the flow passage to the annulus;

a second piston displaceable in a second direction opposite to the first direction in response to the fluid pressure differential; and a valve selectively permitting and preventing fluid flow through the flow passage in response to displacement of one of the first and second pistons.

38. Apparatus operatively positionable in a subterranean well, the apparatus comprising:

a plurality of inflatable packers, each of the packers being radially outwardly extendable from a deflated configuration to an inflated configuration, and the packers being attached to each other; and a plurality of substantially inflexible centralizers attached to the packers, each of the centralizers being radially enlarged relative to the packers in the deflated configurations thereof, and each of the centralizers being radially reduced relative to the packers in the inflated configurations thereof.

* * * * *